US010539922B2

(12) United States Patent
Hashimoto et al.

(10) Patent No.: US 10,539,922 B2
(45) Date of Patent: Jan. 21, 2020

(54) IMAGE FORMING APPARATUS INCLUDING DRAWER

(71) Applicant: Brother Kogyo Kabushiki Kaisha, Nagoya-shi, Aichi-ken (JP)

(72) Inventors: Yohei Hashimoto, Nagakute (JP); Hikaru Iino, Niwa-gun (JP); Masato Makino, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/140,832

(22) Filed: Sep. 25, 2018

(65) Prior Publication Data

US 2019/0196395 A1 Jun. 27, 2019

(30) Foreign Application Priority Data

Dec. 26, 2017 (JP) ..... 2017-249705
Aug. 30, 2018 (JP) ..... 2018-161980

(51) Int. Cl.
*G03G 15/00* (2006.01)
*G03G 21/18* (2006.01)

(52) U.S. Cl.
CPC ..... *G03G 21/1817* (2013.01); *G03G 21/1814* (2013.01)

(58) Field of Classification Search
CPC ..... G03G 21/1817
USPC ..... 399/113
See application file for complete search history.

(56) References Cited

U.S. PATENT DOCUMENTS

| | | | | |
|---|---|---|---|---|
| 8,712,281 | B2 | 4/2014 | Nakano et al. | |
| 9,122,231 | B2 | 9/2015 | Nakano et al. | |
| 2009/0190953 | A1* | 7/2009 | Okabe | G03G 21/1853 399/111 |
| 2012/0183323 | A1 | 7/2012 | Nakano et al. | |
| 2012/0183325 | A1* | 7/2012 | Sato | G03G 15/0194 399/110 |
| 2014/0205319 | A1 | 7/2014 | Nakano et al. | |

FOREIGN PATENT DOCUMENTS

JP 2012-145878 A 8/2012

* cited by examiner

*Primary Examiner* — Quana Grainger
(74) *Attorney, Agent, or Firm* — Banner & Witcoff, Ltd.

(57) ABSTRACT

A drawer unit moves in a moving direction between an internal position inside the main housing and an external position outside the main housing. The drawer unit includes a drawer frame, a first exposure head, and a second contact member. The first exposure head moves between a first adjacent position at which the first exposure head is adjacent to the first photosensitive drum and a first spaced position at which the first exposure head is farther spaced away from the first photosensitive drum than at the first adjacent position. The second contact member is a part of the drawer unit other than the first exposure head. The first exposure head moves from the first adjacent position to the first spaced position due to a contact between the first contact member and the second contact member when the drawer unit moves from the internal position to the external position.

29 Claims, 24 Drawing Sheets

IMAGE FORMING APPARATUS INCLUDING DRAWER

CROSS REFERENCE TO RELATED APPLICATIONS

This application claims priority from Japanese Patent Application Nos. 2017-249705 filed Dec. 26, 2017 and 2018-161980 filed Aug. 30, 2018. The entire content of each of the priority applications is incorporated herein by reference.

TECHNICAL FIELD

This disclosure relates to an image forming apparatus.

BACKGROUND

Conventionally, there is known an image forming apparatus that includes a drum cartridge and a drawer unit. The drum cartridge includes a photosensitive drum. The drawer unit is configured such that the drum cartridge is mounted thereon. The drawer unit includes an exposure head for exposing the photosensitive drum. The exposure head is configured to move between a first position at which the exposure head is adjacent to the photosensitive drum and a second position at which the exposure head is farther away from the photosensitive drum than at the first position.

SUMMARY

According to one aspect, this specification discloses an image forming apparatus. The image forming apparatus includes a main housing, a first drum cartridge, and a drawer unit. The main housing includes a first contact member. The first drum cartridge includes a first photosensitive drum. The drawer unit is configured such that the first drum cartridge is mounted thereon. The drawer unit is configured to move in a moving direction between an internal position at which the drawer unit is located inside the main housing and an external position at which the drawer unit is located outside the main housing. The drawer unit includes a drawer frame, a first exposure head, and a second contact member. The first exposure head is configured to move between a first adjacent position at which the first exposure head is adjacent to the first photosensitive drum and a first spaced position at which the first exposure head is farther spaced away from the first photosensitive drum than at the first adjacent position. The second contact member is a part of the drawer unit other than the first exposure head. The first exposure head is configured to move from the first adjacent position to the first spaced position due to a contact between the first contact member and the second contact member when the drawer unit moves from the internal position to the external position.

BRIEF DESCRIPTION OF THE DRAWINGS

Embodiments in accordance with this disclosure will be described in detail with reference to the following figures wherein.

DETAILED DESCRIPTION

In the image forming apparatus, the exposure head itself contacts the main housing, an impact occurring when the exposure head contacts the main housing is easily transmitted to the exposure head, and an influence such as damage to the exposure head by the impact is concerned.

An example of an object of this disclosure is to provide an image forming apparatus configured to suppress an impact occurring when an exposure head contacts a main housing from being transmitted to the exposure head.

1. Image Forming Apparatus

An image forming apparatus is described with reference to FIGS. 1 and 2.

Figure 1:
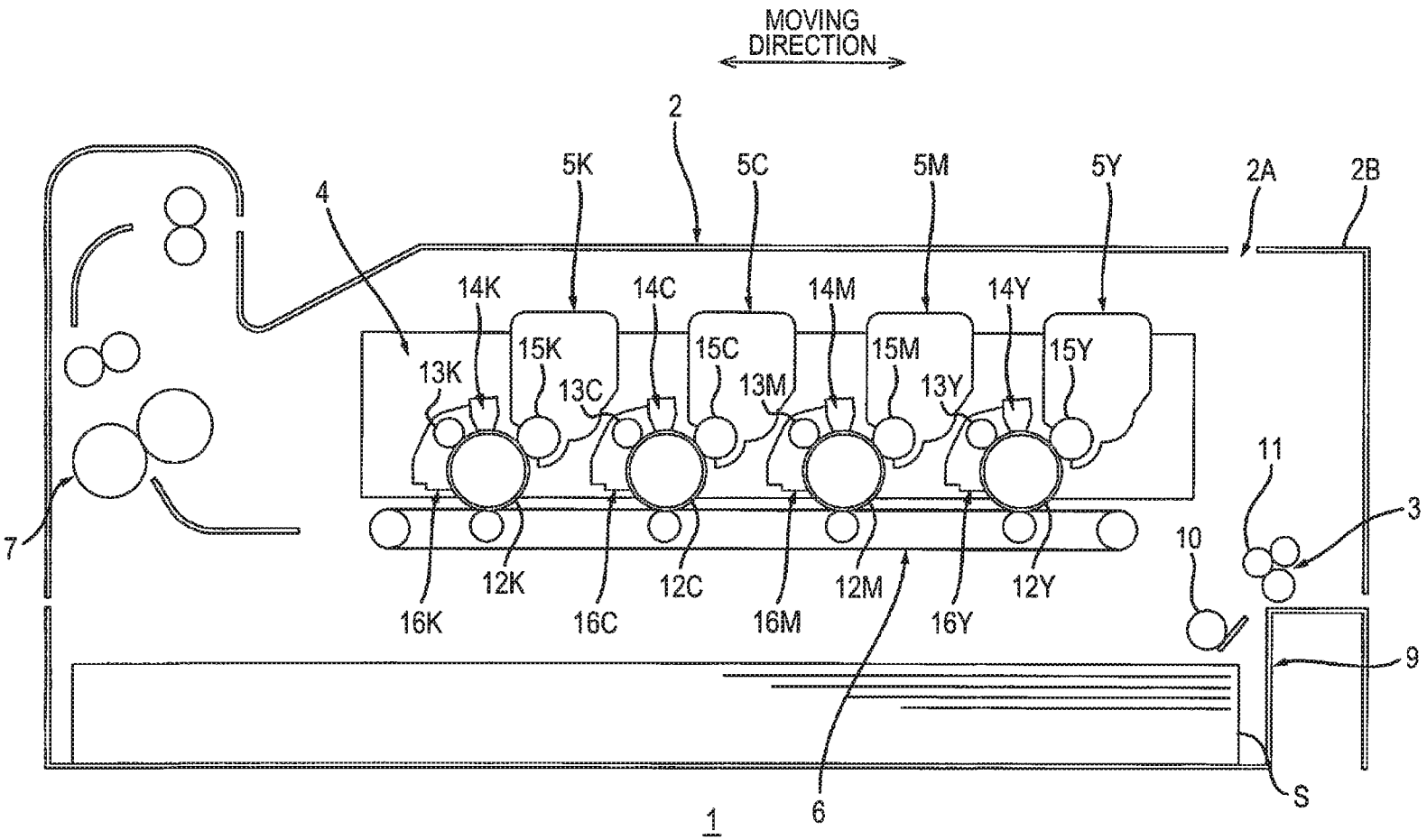
FIG. 1 is a schematic diagram of an image forming apparatus.

As shown in FIG. 1, an image forming apparatus 1 includes a main housing 2, a feeder 3, a drawer unit 4, a plurality of drum cartridges 16Y, 16M, 16C, 16K, a plurality of developing cartridges 5Y, 5M, 5C, 5K, a transfer unit 6, and a fixing device 7.

1.1 Main Housing

The main housing 2 forms an exterior of the image forming apparatus 1. The main housing 2 accommodates the feeder 3, the drawer unit 4, the plurality of developing cartridges 5Y, 5M, 5C, 5K, the transfer unit 6, and the fixing device 7. The main housing 2 has an opening 2A. The opening 2A is located at an opposite side from the fixing device 7 with respect to the drawer unit 4 in a state where the drawer unit 4 is located at an internal position. The internal position is described later. In addition, the main housing 2 includes a cover 2B. The cover 2B is configured to move between a closed position (see FIG. 1) at which the opening 2A is closed and an open position (see FIG. 2) at which the opening 2A is open.

1.2 Feeder

The feeder 3 is configured to supply a sheet S to a photosensitive drum 12Y. The sheet S is, for example, printing paper. The photosensitive drum 12Y is described later. The feeder 3 includes a sheet feed tray 9, a pick-up roller 10, and a sheet feed roller 11. The sheet feed tray 9 accommodates the sheet S. The pick-up roller 10 is configured to convey the sheet S that is inside the sheet feed tray 9 to the sheet feed roller 11. The sheet feed roller 11 is configured to convey the sheet S from the pick-up roller 10 to the photosensitive drum 12Y.

1.3 Drawer Unit

Figure 2:
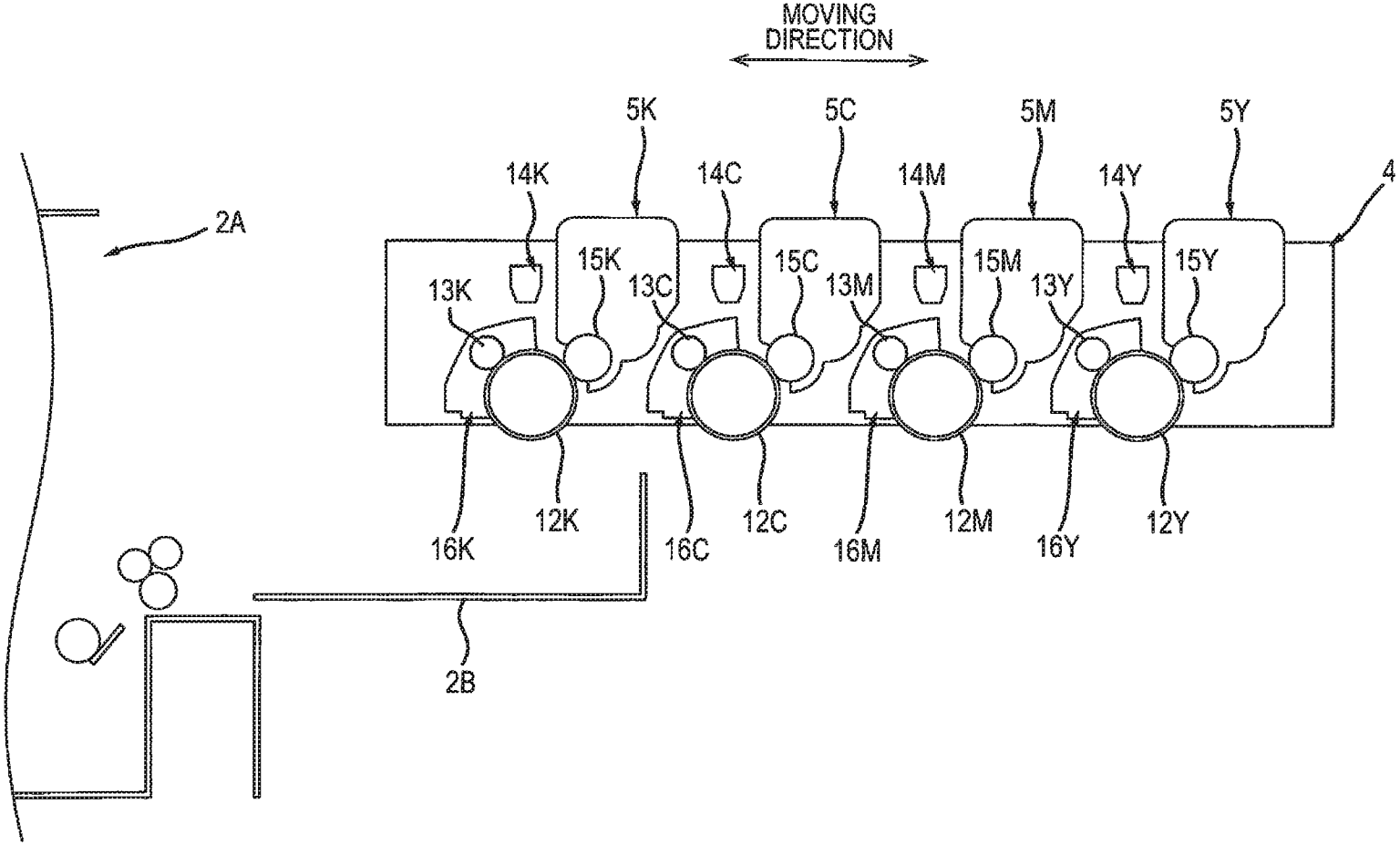
FIG. 2 shows a state where a drawer unit shown in FIG. 1 is located at an external position.

As shown in FIG. 2, the drawer unit 4 moves between an internal position (see FIG. 1) and an external positon (see FIG. 2) through the opening 2A when the cover 2B is at the open position. The internal position is a position of the drawer unit 4 when the drawer unit 4 is located inside the main housing 2. The external positon is a position of the drawer unit 4 when the drawer unit 4 is located outside of the main housing 2. A direction in which the drawer unit 4 moves between the internal position and the external position is defined as a moving direction. As shown in FIG. 1, the drawer unit 4 includes a plurality of exposure heads 14Y, 14M, 14C, 14K.

The plurality of exposure heads 14Y, 14M, 14C, 14K forms a row along the moving direction with intervals between the exposure heads. The exposure head 14Y is located above the photosensitive drum 12Y in a state where the drum cartridge 16Y is mounted on the drawer unit 4. The exposure head 14Y is configured to expose the photosensitive drum 12Y. The exposure head 14M is located above the photosensitive drum 12M in a state where the drum cartridge 16M is mounted on the drawer unit 4. The exposure head 14M is configured to expose the photosensitive drum 12M. The exposure head 14C is located above the photosensitive drum 12C in a state where the drum cartridge 16C is mounted on the drawer unit 4. The exposure head 14C is configured to expose the photosensitive drum 12C. The exposure head 14K is located above the photosensitive drum 12K in a state where the drum cartridge 16K is mounted on the drawer unit 4. The exposure head 14K is configured to expose the photosensitive drum 12K.

1.4 Plurality of Drum Cartridges

Each of the plurality of drum cartridges 16Y, 16M, 16C, 16K is configured to be mounted onto the drawer unit 4 when the drawer unit 4 is at the external position (see FIG. 2). In a state where the plurality of drum cartridges 16Y, 16M, 16C, 16K is mounted on the drawer unit 4, the plurality of drum cartridges 16Y, 16M, 16C, 16K forms a row along the moving direction with intervals between the drum cartridges.

The drum cartridge 16Y includes a photosensitive drum 12Y, and a charger 13Y.

The photosensitive drum 12Y rotates about a particular rotational axis. A direction in which the rotational axis of the photosensitive drum 12Y extends is defined as an axial direction. The axial direction intersects the moving direction and the upper-lower direction. The photosensitive drum 12Y extends in the axial direction. The photosensitive drum 12Y has a cylindrical shape.

The charger 13Y is configured to charge the surface of the photosensitive drum 12Y. The charger 13Y charges the surface of the photosensitive drum 12Y. Then, the exposure head 14Y exposes the surface of the charged photosensitive drum 12Y, to thereby form an electrostatic latent image on the surface of the photosensitive drum 12Y. The charger 13Y is located at an opposite side from a developing roller 15Y with respect to the exposure head 14Y in the moving direction in a state where the drum cartridge 16Y is mounted on the drawer unit 4. The developing roller 15Y is described later. The charger 13Y is located at an upstream side of the exposure head 14Y in a direction of rotation of the photosensitive drum 12Y in a state where the drum cartridge 16Y is mounted on the drawer unit 4. More specifically, the charger 13Y is a charging roller. Note that the charger 13Y may be a scorotron charger.

Note that the drum cartridge 16M includes the photosensitive drum 12M and a charger 13M. The drum cartridge 16C includes the photosensitive drum 12C and a charger 13C. The drum cartridge 16K includes the photosensitive drum 12K and a charger 13K. The drum cartridges 16M, 16C, 16K all have the same structure as the drum cartridge 16Y and are described in the same way as the drum cartridge 16Y. Therefore, a description of the drum cartridges 16M, 16C, 16K is omitted.

1.4 Plurality of Developing Cartridges

The plurality of developing cartridges 5Y, 5M, 5C, 5K is configured to be mounted onto the drawer unit 4 when the drawer unit 4 is at the external position (see FIG. 2). The developing cartridge 5Y is configured to store toner that is supplied to the photosensitive drum 12Y. The developing cartridge 5Y includes the developing roller 15Y.

The developing roller 15Y is configured to supply toner stored in the developing cartridge 5Y to the photosensitive drum 12Y. An electrostatic latent image is developed by supplying the toner stored in the developing cartridge 5Y to the photosensitive drum 12Y on which the electrostatic latent image has been formed. With this, a toner image is formed on the surface of the photosensitive drum 12Y. In other words, the toner image is formed on the surface of the photosensitive drum 12Y by electrostatically moving the toner from the developing roller 15Y to the photosensitive drum 12Y and developing the electrostatic latent image that is formed on the photosensitive drum 12Y. A part of the developing roller 15Y is accommodated in the developing cartridge 5Y. The developing roller 15Y is located at a downstream side of the exposure head 14Y in the direction of rotation of the photosensitive drum 12Y in a state where the drum cartridge 16Y and the developing cartridge 5Y are mounted on the drawer unit 4. The developing roller 15Y contacts the surface of the photosensitive drum 12Y in a state where the developing cartridge 5Y is mounted on the drawer unit 4.

Note that the developing cartridge 5M is configured to store the toner that is supplied to the photosensitive drum 12M and includes the developing roller 15M. The developing cartridge 5C is configured to store the toner that is supplied to the photosensitive drum 12C and includes the developing roller 15C. The developing cartridge 5K is configured to store the toner that is supplied to the photosensitive drum 12K and includes the developing roller 15K. The developing cartridges 5M, 5C, 5K all have the same structure as the developing cartridge 5Y and are described in the same way as the developing cartridge 5Y. Therefore, a description of the developing cartridges 5M, 5C, 5K is omitted.

1.5 Transfer Unit

The transfer unit 6 is located below the plurality of photosensitive drums 12Y, 12M, 12C, 12K in a state where the drawer unit 4 is at the internal position. The transfer unit 6 contacts the plurality of photosensitive drums 12Y, 12M, 12C, 12K in a state where the drawer unit 4 is at the internal position. The transfer unit 6 conveys the sheet S that is supplied from the feeder 3 to the fixing device 7. The transfer unit 6 transfers toner images of each of the plurality of photosensitive drums 12Y, 12M, 12C, 12K onto the sheet S when the sheet S contacts each of the plurality of photosensitive drums 12Y, 12M, 12C, 12K.

1.6 Fixing Device

The fixing device 7 is configured to heat and apply pressure to the sheet S on which the toner image has been transferred to affix the toner image to the sheet S. The sheet S passes through the fixing device 7 and is discharged to a top surface of the main housing 2.

2. Movement of Exposure Head

Movement of the plurality of exposure heads 14Y, 14M, 14C, 14K will be described below with reference to FIG. 1 and FIG. 2.

The exposure head 14Y is configured to move between a first adjacent position (see FIG. 1) adjacent to the photosensitive drum 12Y and a first spaced position (see FIG. 2) farther spaced away from the photosensitive drum 12Y than at the first adjacent position. The exposure head 14Y moves from the first adjacent position to the first spaced position due to a contact of a part of the drawer unit 4 with the main housing 2 while the drawer unit 4 moves from an internal position to an external position. The part of the drawer unit 4 is a part other than the exposure head 14Y.

The drum cartridge 16Y cannot be removed from the drawer unit 4 in a state where the exposure head 14Y is located, and can be removed from the drawer unit 4 in a state where the exposure head 14Y is located at the first spaced position.

While the drawer unit 4 moves from the internal position to the external position, the exposure head 14M is separated from the photosensitive drum 12M, the exposure head 14C is separated from the photosensitive drum 12C, and the exposure head 14K is separated from the photosensitive drum 12K.

A mechanism to move the plurality of heads 14Y, 14M, 14C, 14K while the drawer unit 4 moves from the internal position to the external position will be explained with reference to embodiments.

3. First Embodiment

A first embodiment will be described with reference to FIG. 3 to FIG. 11.

3.1 Details of Drawer Unit

Figure 3:
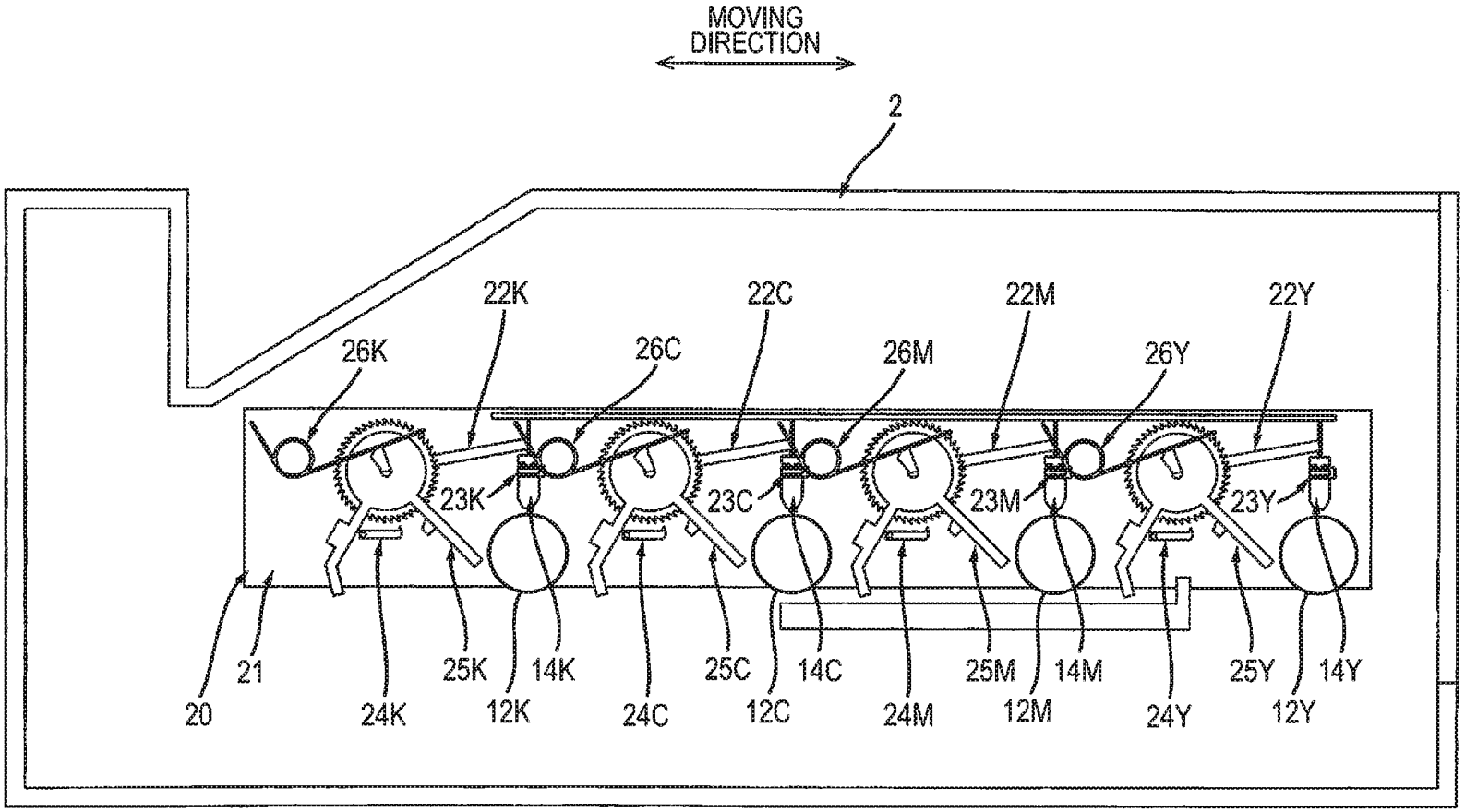
FIG. 3 is a schematic diagram of an image forming apparatus according to a first embodiment.

As shown in FIG. 3, a drawer unit 20 includes, in addition to the plurality of exposure heads 14Y, 14M, 14C, 14K, a drawer frame 21, a plurality of first levers 22Y, 22M, 22C, 22K, a plurality of second levers 23Y, 23M, 23C, 23K, a plurality of stoppers 24Y, 24M, 24C, 24K, a plurality of third levers 25Y, 25M, 25C, 25K, and a plurality of springs 26Y, 26M, 26C, 26K. On the drawer unit 20, like the drawer unit 4 (see FIG. 1), a plurality of drum cartridges 16Y, 16M, 16C, 16K (see FIG. 1) is configured to be mounted.

The plurality of first levers 22Y, 22M, 22C, 22K has the same structures, respectively, and will be similarly explained. For this reason, in the following explanation, the first lever 22Y is explained, and explanations of the first levers 22M, 22C, 22K are omitted. Similarly, with respect to the plurality of second levers 23Y, 23M, 23C, 23K, the plurality of stoppers 24Y, 24M, 24C, 24K, the plurality of third levers 25Y, 25M, 25C, 25K, and the plurality of springs 26Y, 26M, 26C, 26K, the second lever 23Y, the stopper 24Y, the third lever 25Y, and the spring 26Y will be described, and descriptions of the second levers 23M, 23C, 23K, the stoppers 24M, 24C, 24K, the third levers 25M, 25C, 25K, and the springs 26M, 26C, 26K will be omitted.

3.1.1 Drawer Frame

Figure 4:
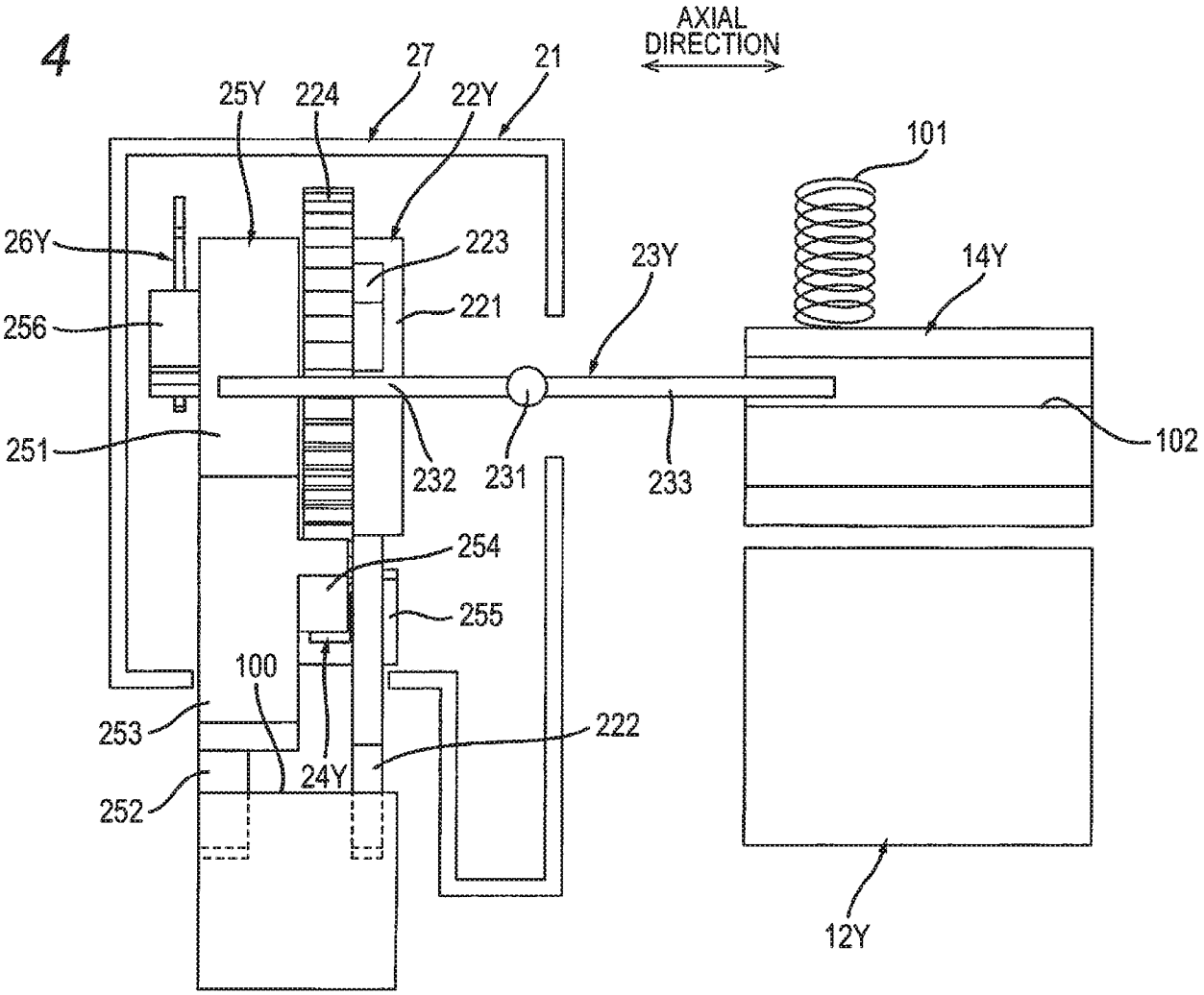
FIG. 4 is a cross-sectional view of a drawer unit shown in FIG. 3.

The drawer frame 21 includes a first side frame 27 shown in FIG. 4 and a second side frame (not shown).

The first side frame 27 extends in the moving direction. The first side frame 27 contains the plurality of first levers 22Y, 22M, 22C, 22K, the plurality of second levers 23Y, 23M, 23C, 23K, the plurality of stoppers 24Y, 24M, 24C, 24K, the plurality of third levers 25Y, 25M, 25C, 25K, and the plurality of springs 26Y, 26M, 26C, 26K.

The second side frame is located at the opposite side of the first side frame 27 with respect to the photosensitive drum 12Y in an axial direction. The second side frame will be explained like the first side frame 27. For this reason, the explanation about the second side frame will be omitted.

3.1.2 First Lever

The first lever 22Y, as shown in FIG. 4, is attached to the first side frame 27. The first lever 22Y is configured to rotatably move with respect to the drawer frame 21. The first lever 22Y rotates with respect to the drawer frame 21 so as to be able to move between a pressing position (see FIG. 6) and a pressing release position (non-pressing position) (see FIG. 5).

Figure 5:
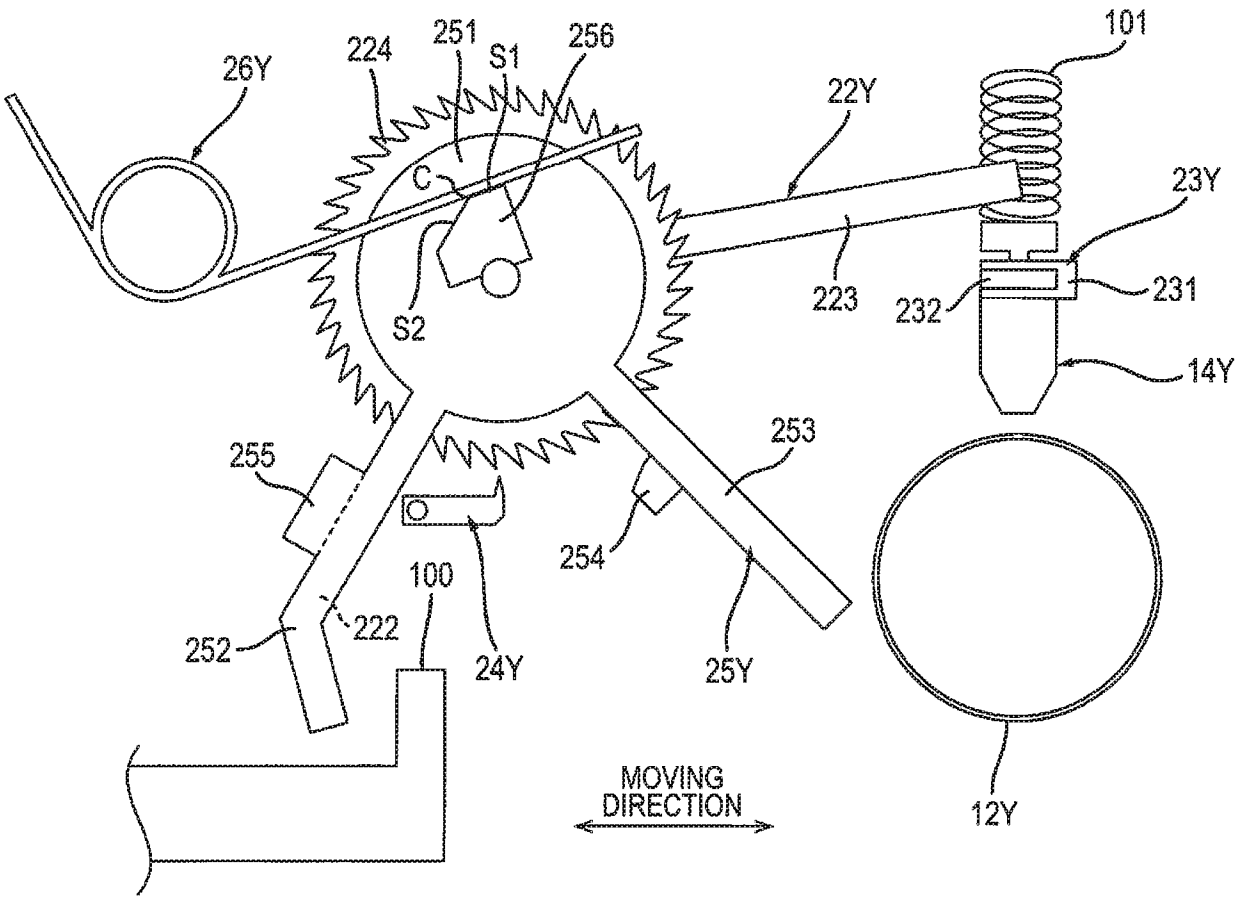
FIG. 5 is an explanatory diagram for illustrating movement of a first lever, a third lever, and a stopper when the drawer unit shown in FIG. 3 moves from an internal position to an external position, and shows a state before the first lever and the third lever contacts a protrusion of a main housing, the first lever is located at a pressing release position, the third lever is located at a spaced position, and the stopper is located at an engagement release position.
Figure 6:
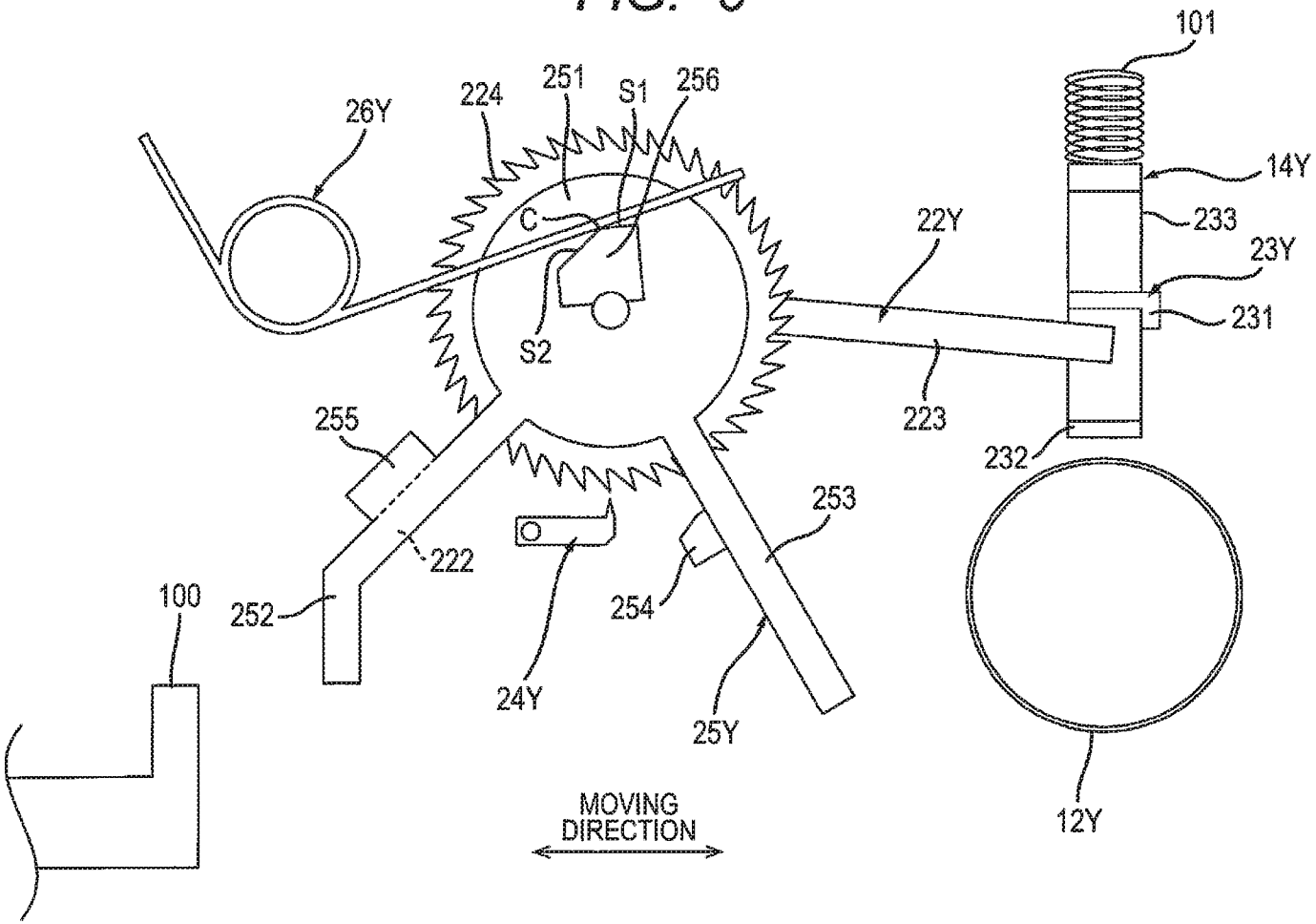
FIG. 6 is an explanatory diagram continuing from FIG. 5, and shows a state after the first lever and the third lever contact the protrusion of the main housing, the first lever is located at a pressing position, the third lever is in the middle of moving from a spaced position to a contact position, and the stopper is located at the engagement release position.
Figure 7:
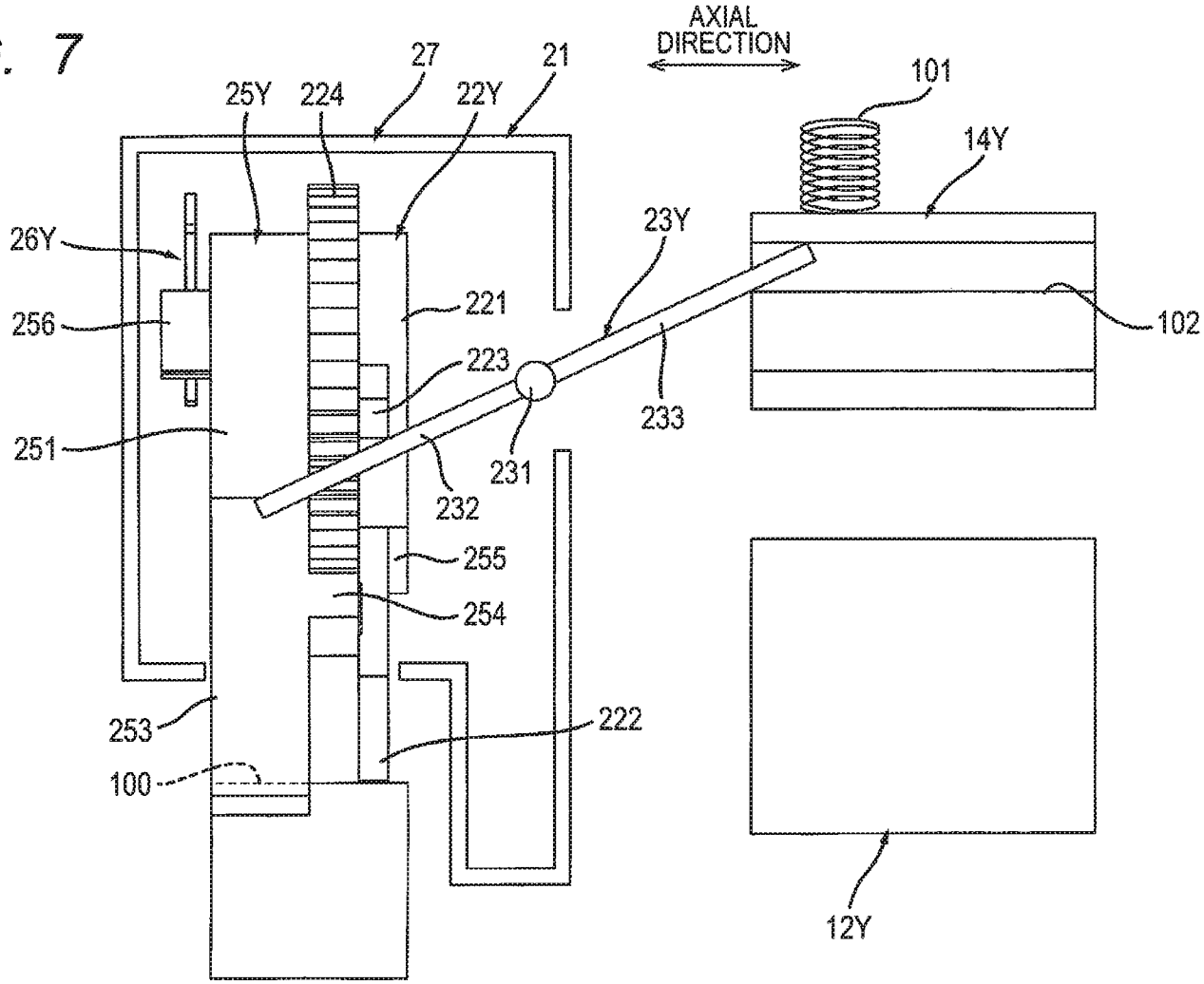
FIG. 7 is a cross-sectional view of the drawer unit in the state shown in FIG. 6.

As shown in FIG. 5 and FIG. 6, when the drawer unit 20 moves from the internal position to the external position, the first lever 22Y contacts a protrusion 100 (an example of a first contact member) provided in the main housing 2 so as to move from the pressing release position to the pressing position. When the first lever 22Y is located at the pressing position, the first lever 22Y presses a first rod 232 of the second lever 23Y. At this time, as shown in FIG. 7, the second lever 23Y rotatably moves about a rotating shaft 231 and causes a second rod 233 to press the exposure head 14Y upward against pressing force of a spring 101. In this manner, the exposure head 14Y moves from a first adjacent position to a first spaced position. That is, the first lever 22Y (an example of a second contact member) is a part of the drawer unit 20 configured to contact the main housing 2. The exposure head 14Y moves from the first adjacent position to the first spaced position due to movement of the first lever 22Y from the pressing release position to the pressing position. The second lever 23Y will be explained later in detail.

The spring 101 is disposed in the drawer unit 20. The spring 101 presses the exposure head 14Y in a direction from a first spaced position (see FIG. 7) to a first adjacent position (see FIG. 4).

Figure 8:
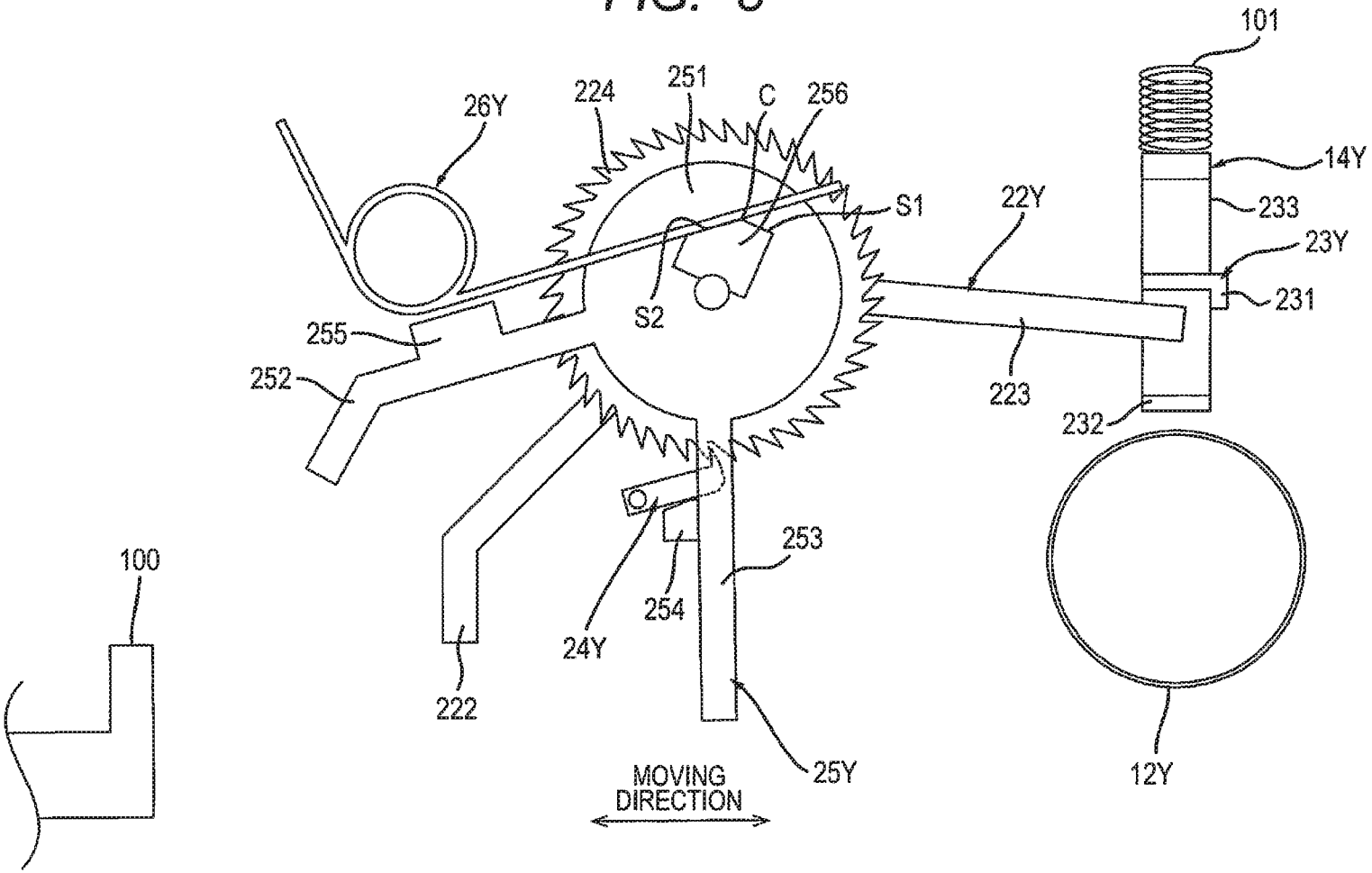
FIG. 8 is an explanatory diagram continuing from FIG. 6, and shows a state where the first lever is located at the pressing position, the third lever is located at the contact position, and the stopper is located at an engagement position.
Figure 9:
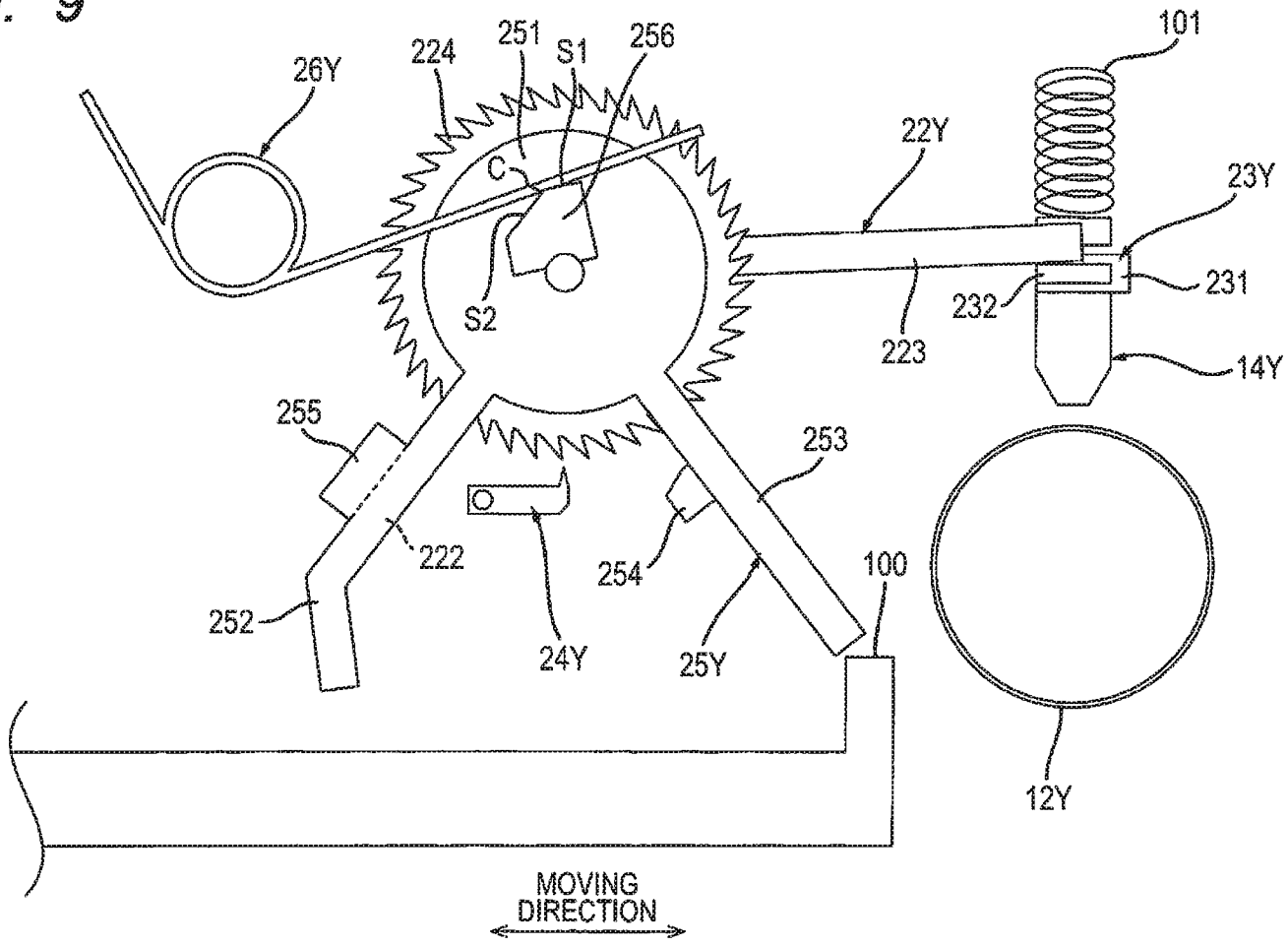
FIG. 9 is an explanatory diagram for illustrating movement of the first lever, the third lever, and the stopper when the drawer unit shown in FIG. 8 moves from the external position to the internal position, and shows a state after the third lever contacts the protrusion of the main housing, when the third lever is in the middle of moving from the contact position to the spaced position, when the stopper is located at the engagement release position, and when the first lever is in the middle of moving from the pressing position to the pressing release position.
Figure 10:
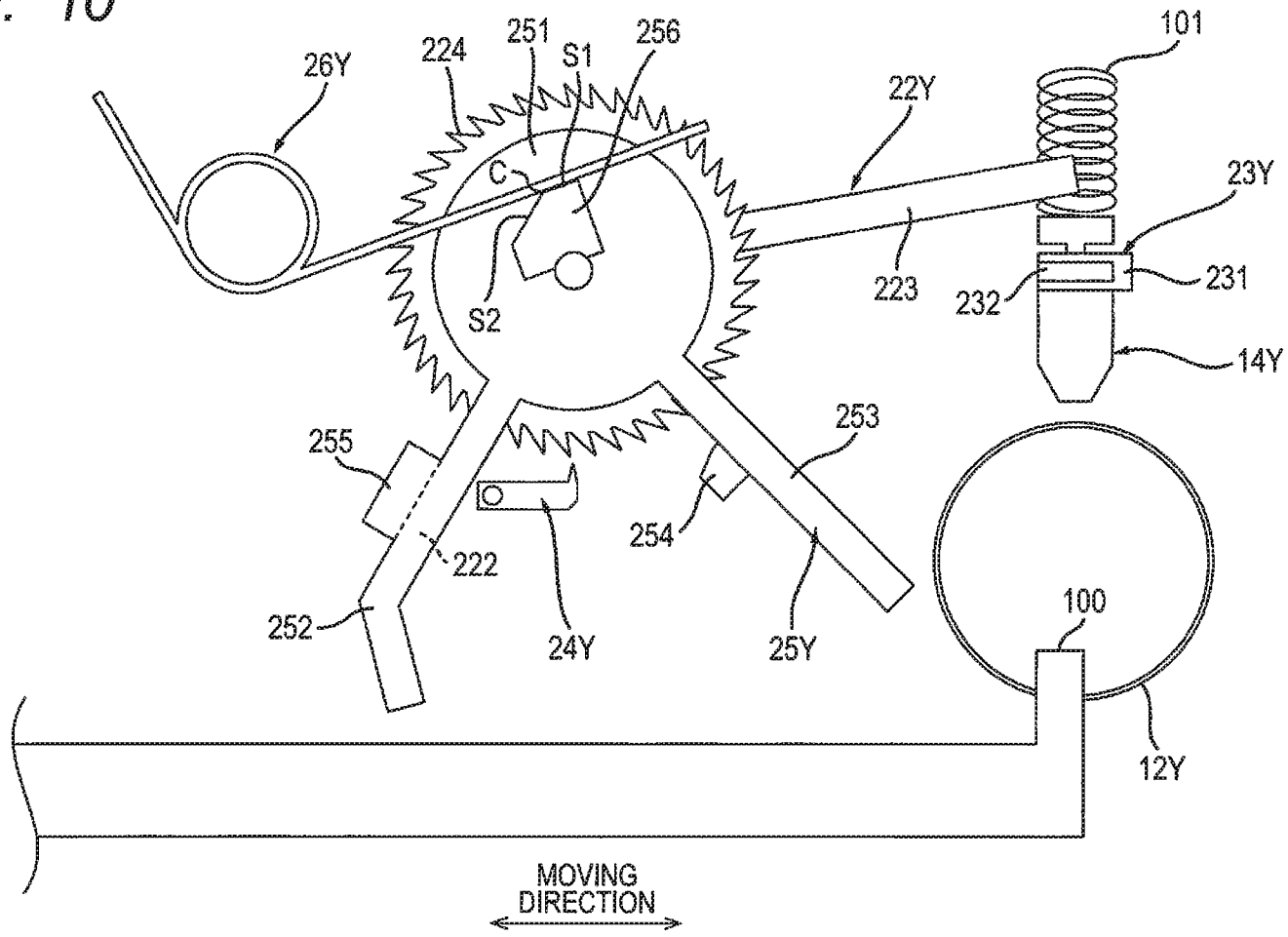
FIG. 10 is an explanatory diagram continuing from FIG. 9, and shows a state where the third lever is located at the spaced position, the first lever is located at the pressing release position, and the stopper is located at the engagement release position.

As shown in FIG. 8 to FIG. 10, when the drawer unit 20 moves from the external position to the internal position (when the mechanism moves in the order of FIG. 8→FIG. 9→FIG. 10), the first lever 22Y moves from a pressing position (see FIG. 8) at which the first lever 22Y presses the second lever 23Y to a pressing release position (see FIG. 10) at which the first lever 22Y does not press the second lever 23Y. When the first lever 22Y is located at the pressing release position, the first lever 22Y stops pressing on the second lever 23Y. At this time, the exposure head 14Y moves from the first spaced position to the first adjacent position by the pressing force of the spring 101.

Figure 11:
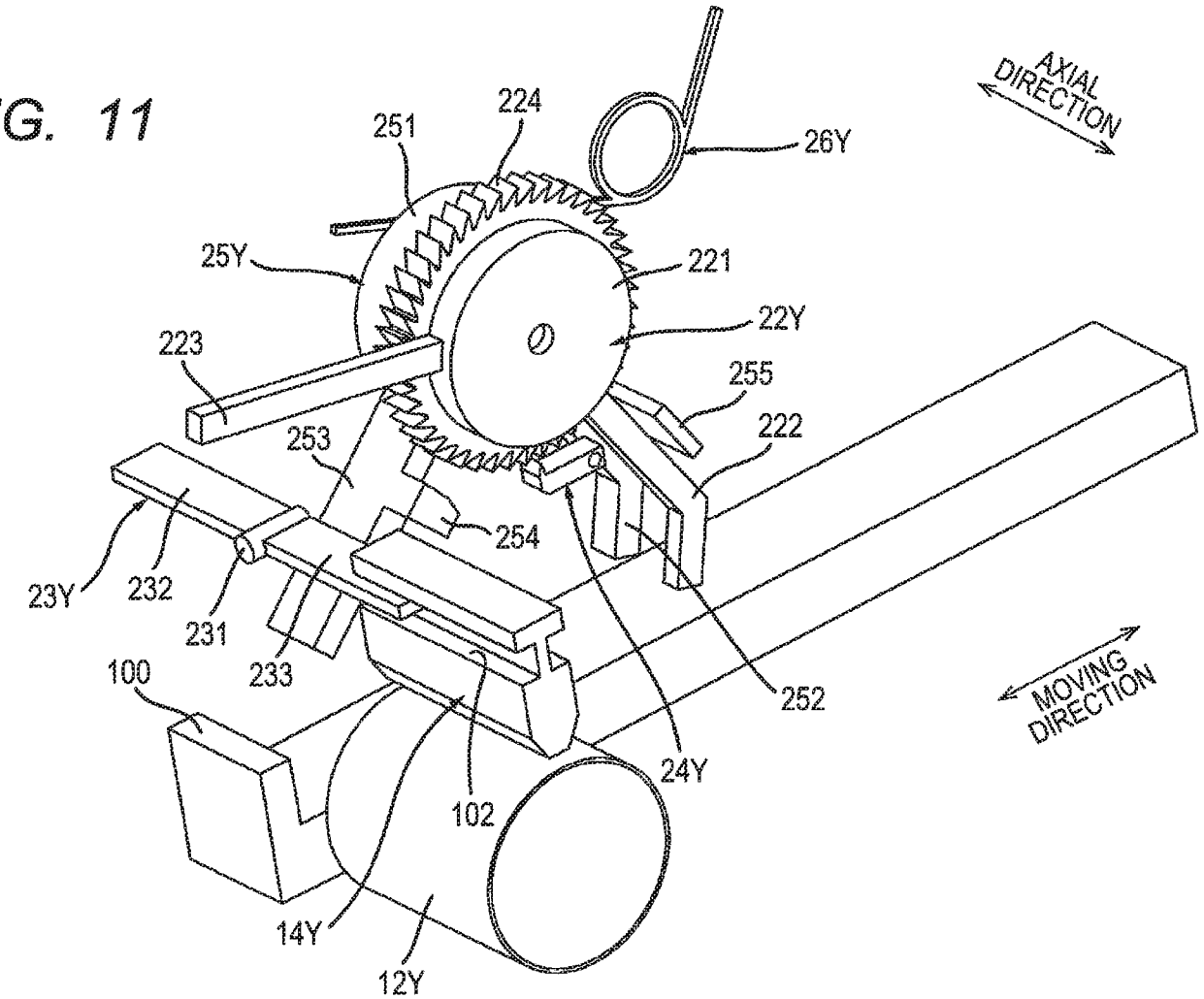
FIG. 11 is a perspective view of the first lever, a second lever, the stopper, and the third lever.

The first lever 22Y, as shown in FIG. 11, has a disk 221, a first rod 222, a second rod 223, and a plurality of gear teeth 224.

The disk 221 is rotatably supported by a first side frame 27 (see FIG. 4). In this manner, the first lever 22Y is configured to rotatably move with respect to the drawer frame 21. A rotational axis of the disk 221 extends in the axial direction.

The first rod 222 extends from the disk 221. The first rod 222 extends downward from the disk 221 in a state where the first lever 22Y is located at the pressing release position. The first rod 222 contacts the main housing 2 when the drawer unit 20 moves from the internal position to the external position. More specifically, the first rod 222 contacts the protrusion 100 of the main housing 2 when the drawer unit 20 moves from the internal position to the external position in a state where the first lever 22Y is located at the pressing release position. In this manner, the first lever 22Y moves from the pressing release position to the pressing position.

The second rod 223 extends from the disk 221. The second rod 223 is arranged at an interval from the first rod 222 in the circumferential direction of the disk 221. The second rod 223 is located to be spaced from the first rod 232 above the first rod 232 of the second lever 23Y in a state where the first lever 22Y is located at the pressing release position. The second rod 223 contacts the first rod 232 of the second lever 23Y due to movement of the first lever 22Y from the pressing release position to the pressing position. The second rod 223 presses the first rod 232 of the second lever 23Y when the first lever 22Y is located at the pressing position.

The plurality of gear teeth 224 is located at the edge of the disk 221. The plurality of gear teeth 224 is arranged in the rotating direction of the first lever 22Y.

3.1.3 Second Lever

The second lever 23Y, as shown in FIG. 4, is attached to the first side frame 27. More specifically, the drawer unit 20 includes a second lever 23Y. The second lever 23Y, as shown in FIG. 7, is configured to be rotated by being pressed by the first lever 22Y. The second lever 23Y rotates to move the exposure head 14Y. More specifically, the second lever 23Y contacts the first lever 22Y while the drawer unit 20 moves from the internal position to the external position so as to move the exposure head 14Y. The second lever 23Y is a moving member. More specifically, the first lever 22Y serving as a part of the drawer unit 20 configured to contact the main housing 2 moves the exposure head 14Y through the second lever 23Y serving as the moving member. The second lever 23Y has the rotating shaft 231, the first rod 232, and the second rod 233.

The rotating shaft 231 is rotatably supported by the first side frame 27. The rotating shaft 231 extends in the moving direction. The rotating shaft 231 has a columnar shape. The second lever 23Y is configured to rotatably move about the rotating shaft 231.

The first rod 232 extends from the rotating shaft 231. The first rod 232 is located at the opposite side of the second rod 233 with respect to the rotating shaft 231. The first rod 232 contacts the second rod 223 of the first lever 22Y (see FIG. 6) when the first lever 22Y moves from the pressing release position to the pressing position.

The second rod 233 extends from the rotating shaft 231 to the exposure head 14Y. The second rod 233 contacts the exposure head 14Y. More specifically, the exposure head 14Y has a groove 102. The second rod 233 is fitted in the groove 102.

3.1.4 Stopper

As shown in FIG. 8, the stopper (pawl) 24Y engages the gear teeth 224 of the first lever 22Y to stop the rotation of the first lever 22Y. The stopper 24Y is configured to move between an engagement position at which the stopper 24Y is engaged with the gear teeth 224 (see FIG. 8) and an engagement release position (see FIG. 10) at which the gear teeth 224 are disengaged from the gear teeth 224. The stopper 24Y constitutes a ratchet together with the plurality of gear teeth 224. The stopper 24Y is located outside the plurality of gear teeth 224 in the radial direction of the disk 221 (see FIG. 11) of the first lever 22Y. In other words, the plurality of gear teeth 224 is located between the disk 221 and the stopper 24Y in the radial direction of the disk 221 of the first lever 22Y. More specifically, the stopper 24Y is located below the plurality of gear teeth 224.

3.1.5 Third Lever

The third lever 25Y, as shown in FIG. 8, causes the stopper 24Y to be located at the engagement position in a state where the drawer unit 20 is located at the external position. In this manner, the third lever 25Y fixes the first lever 22Y at the pressing position in a state where the drawer unit 20 is located at the external position. The first lever 22Y is fixed at the pressing position, and thereby the exposure head 14Y is fixed at the first spaced position.

The third lever 25Y, as shown in FIG. 8 to FIG. 10, presses the first lever 22Y from the pressing position to the pressing release position while the drawer unit 20 moves from the external position to the internal position. In this manner, the fixing of the exposure head 14Y is stopped, and the exposure head 14Y moves from the first spaced position to the first adjacent position by the pressing force of the spring 101.

The third lever 25Y, as shown in FIG. 4, is attached to the first side frame 27. The third lever 25Y and the first lever 22Y are arranged in the axial direction. The third lever 25Y is located at the opposite side of the exposure head 14Y in the axial direction with respect to the first lever 22Y. The third lever 25Y is configured to rotatably move with respect to the first lever 22Y. The third lever 25Y is configured to rotatably move about the rotational axis of the first lever 22Y. The third lever 25Y is configured to rotatably move between a contact position (see FIG. 8) and a spaced position (see FIG. 10). When the third lever 25Y is located at the contact position, the third lever 25Y contacts the stopper 24Y to cause the stopper 24Y to be located at the engagement position. When the third lever 25Y is located at the spaced position, the third lever 25Y is separated from the stopper 24Y.

The third lever 25Y, as shown in FIG. 10, has a disk 251, a first rod 252, a second rod 253, a first protrusion 254, a second protrusion 255, and a third protrusion 256.

The disk 251 is configured to rotate with respect to the disk 221 (see FIG. 4) of the first lever 22Y. In this manner, the third lever 25Y is configured to rotatably move with respect to the first lever 22Y. The rotational axis of the disk 251 extends in the axial direction. The rotational axis of the disk 251 matches the rotational axis of the disk 221 of the first lever 22Y. In this manner, the third lever 25Y is configured to rotatably move about the rotational axis of the first lever 22Y.

The first rod 252 extends from the disk 251. The first rod 252 extends downward from the disk 251 in a state where the third lever 25Y is located at the spaced position. As shown in FIG. 11, the first rod 252 and the first rod 222 of the first lever 22Y are arranged in the axial direction when the first lever 22Y is located at the pressing release position and the third lever 25Y is located at the spaced position. The first rod 252 contacts the main housing 2 together with the first rod 222 of the first lever 22Y while the drawer unit 20 moves from the internal position to the external position. More specifically, the first rod 252 contacts the protrusion 100 of the main housing 2 together with the first rod 222 of the first lever 22Y when the drawer unit 20 moves from the internal position to the external position in a state where the third lever 25Y is located at the spaced position. The first rod 252 contacts the protrusion 100 of the first rod 252 to move the third lever 25Y from the spaced position to the contact position.

The second rod 253, as shown in FIG. 10, extends from the disk 251. The second rod 253 is arranged at an interval from the first rod 252 in the circumferential direction of the disk 251. The second rod 253 does not contact the protrusion 100 of the main housing 2 when the drawer unit 20 moves from the internal position to the external position in a state where the third lever 25Y is located at the spaced position. As shown in FIG. 8 and FIG. 9, the second rod 253 contacts the main housing 2 while the drawer unit 20 moves from the external position to the internal position. More specifically, the second rod 253 contacts the protrusion 100 of the main housing 2 when the drawer unit 20 moves from the external position to the internal position in a state where the third lever 25Y is located at the contact position. The second rod 253 contacts the protrusion 100 to move the third lever 25Y from the contact position to the spaced position.

The first protrusion 254, as shown in FIG. 11, is provided at the second rod 253. The first protrusion 254 protrudes from the second rod 253. The first protrusion 254 extends in the axial direction. The first protrusion 254, as shown in FIG. 6 and FIG. 8, presses the stopper 24Y from the engagement release position to the engagement position when the third lever 25Y moves from the spaced position to the contact position. The first protrusion 254, as shown in FIG. 8, contacts the stopper 24Y located at the engagement position when the third lever 25Y is located at the contact position.

The second protrusion 255, as shown in FIG. 11, is provided at the first rod 252. The second protrusion 255 protrudes from the first rod 252. The second protrusion 255 extends in the axial direction. The second protrusion 255, as shown in FIG. 8 to FIG. 10, presses the first lever 22Y from the pressing position to the pressing release position when the third lever 25Y moves from the contact position to the spaced position. More specifically, the second protrusion 255 presses the first lever 22Y from the pressing position to the pressing release position by contacting the first rod 222 of the first lever 22Y when the third lever 25Y moves from the contact position to the spaced position. In this manner, while the drawer unit 20 moves from the external position to the internal position, the first lever 22 is returned to the pressing release position, and the exposure head 14Y is returned to the first adjacent position.

The third protrusion 256, as shown in FIG. 10, is provided at the disk 251. The third protrusion 256 protrudes from the disk 251. The third protrusion 256 extends in the axial direction. The third protrusion 256 has a first surface S1 and a second surface S2. The first surface S1 contacts the spring 26Y in a state where the third lever 25Y is located at the spaced position. The first surface S1 does not contact the spring 26Y in a state where the third lever 25Y is located at the contact position (see FIG. 8). The first surface S1 is a flat surface. The second surface S2, as shown in FIG. 8, contacts the spring 26Y in a state where the third lever 25Y is located at the contact position. The second surface S2 does not contact the spring 26Y in a state where the third lever 25Y is located at the spaced position (see FIG. 10). The second surface S2 is a flat surface intersecting the first surface S1.

3.1.6 Spring

The spring 26Y, as shown in FIG. 4, is attached to the first side frame 27. The spring 26Y is a torsion spring. One end of the spring 26Y is fixed to the first side frame 27. The other end of the spring 26Y contacts the third protrusion 256 of the third lever 25Y.

As shown in FIG. 6, when the drawer unit 20 moves from the internal position to the external position, in a state where the first lever 22Y is located at the pressing position and the third lever 25Y is located between the spaced position and the contact position, the spring 26Y presses a corner C in a direction in which the third lever 25Y moves from the spaced position to the contact position. The corner C is formed by the first surface S1 and the second surface S2. In this manner, as shown in FIG. 8, the third lever 25Y moves to the contact position by pressing force of the spring 26Y. The spring 26Y presses the second surface S2 when the third lever 25Y is located at the contact position. More specifically, when the third lever 25Y is located at the contact position, the spring 26Y presses the second surface S2 of the third protrusion 256 in a direction in which the third lever 25Y moves from the spaced position to the contact position. In this manner, the third lever 25Y is fixed at the contact position by the pressing force of the spring 26Y. The stopper 24Y is fixed at the engagement position by the third lever 25Y, and the first lever 22Y is fixed at the pressing position by the stopper 24Y. The first lever 22Y is fixed at the pressing position to fix the exposure head 14Y at the first spaced position. When the exposure head 14Y is fixed at the first spaced position, the exposure head 14Y is prevented from returning to the first adjacent position when the drawer unit 50 is located at the external position.

More specifically, the third lever 25Y and the spring 26Y constitute a holding mechanism (fixing mechanism or detent mechanism) together with the plurality of gear teeth 224 and the stopper 24Y, and the holding mechanism fixes the first lever 22Y at the pressing position. The drawer unit 20 includes the holding mechanism, and the holding mechanism includes a ratchet.

As shown in FIG. 9, when the drawer unit 20 moves from the external position to the internal position, in a state where the first lever 22Y is located between the pressing position and the pressing release position and the third lever 25Y is located between the contact position and the spaced position, the spring 26Y presses the corner C in a direction in which the third lever 25Y moves from the contact position to the spaced position. In this manner, as shown in FIG. 10, the third lever 25Y moves to the spaced position by the pressing force of the spring 26Y. The spring 26Y presses the first surface S1 when the third lever 25Y is located at the spaced position. More specifically, when the third lever 25Y is located at the spaced position, the spring 26Y presses the first surface S1 of the third protrusion 256 in a direction in which the third lever 25Y moves from the contact position to the spaced position. In this manner, the third lever 25Y is fixed at the spaced position by the pressing force of the spring 26Y.

3.2 Operations and Effects of First Embodiment

According to the first embodiment, as shown in FIG. 4 and FIG. 7, the first lever 22Y contacts the protrusion 100 of the main housing 2 and then rotates, and the rotating first lever 22Y rotates the second lever 23Y so as to move the exposure head 14Y.

More specifically, the first lever 22Y serving as a part of the drawer unit 20 other than the exposure head 14Y contacts the protrusion 100 of the main housing 2 to move the exposure head 14Y.

For this reason, in comparison with a case in which the exposure head 14Y itself contacts the main housing 2, an impact occurring when the exposure head 14Y contacts the main housing 2 can be suppressed from being transmitted to the exposure head 14Y.

4. Second Embodiment

A second embodiment will be described with reference to FIG. 12 to FIG. 14.

4.1 Details of Drawer Unit

Figure 12:
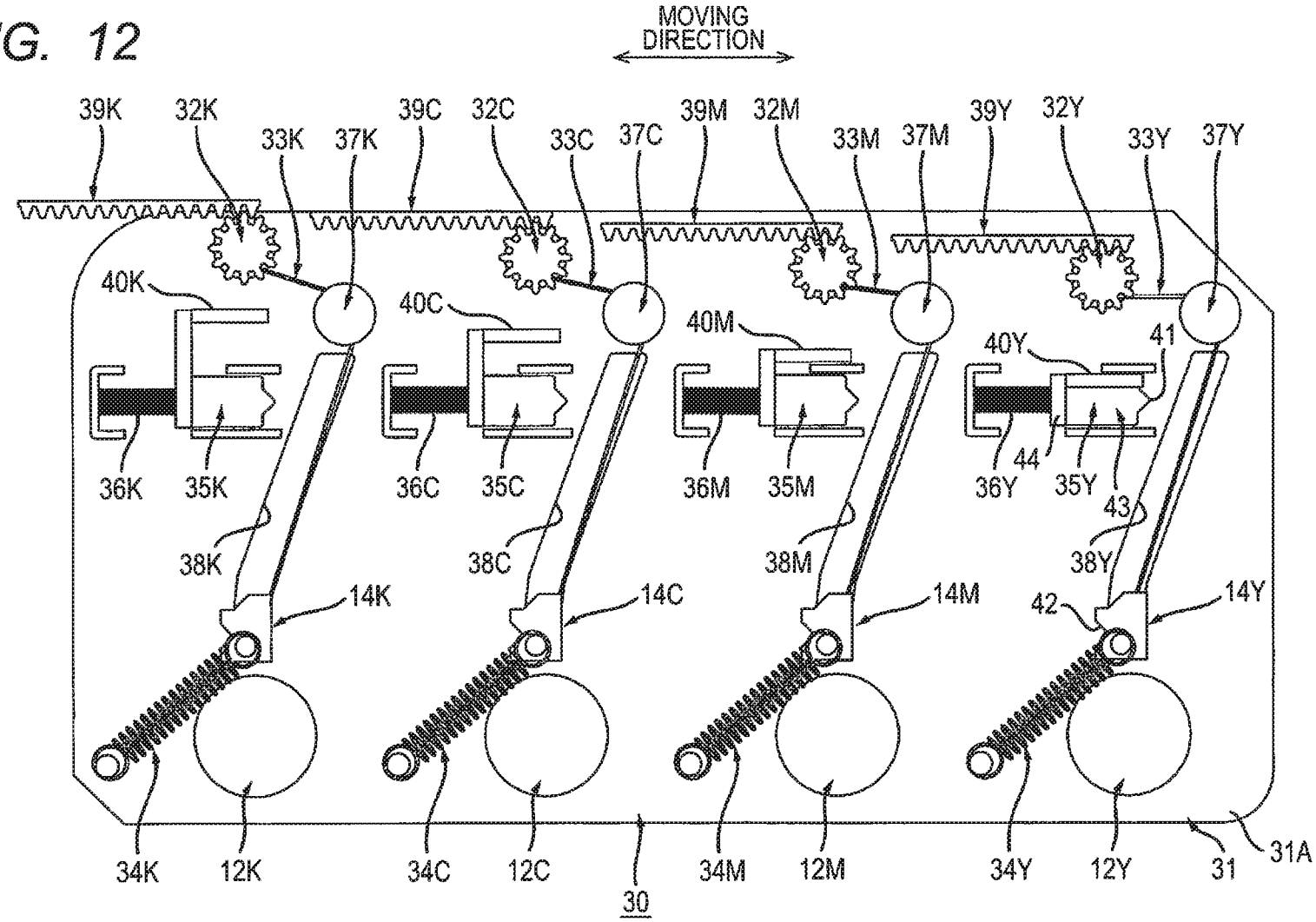
FIG. 12 is a side view of a drawer unit according to a second embodiment, and shows a state where the drawer unit is located at the internal position, an exposure head is located at a first adjacent position, and a lock member is located at a lock release position.

As shown in FIG. 12, a drawer unit 30 includes, in addition to the plurality of exposure heads 14Y, 14M, 14C, 14K, a drawer frame 31, a plurality of gears 32Y, 32M, 32C, 32K, a plurality of wires 33Y, 33M, 33C, 33K, a plurality of first springs 34Y, 34M, 34C, 34K, a plurality of lock members 35Y, 35M, 35C, 35K, a plurality of second springs 36Y, 36M, 36C, 36K, and a plurality of pulleys 37Y, 37M, 37C, 37K. Like the drawer unit 4 (see FIG. 1), a plurality of drum cartridges 16Y, 16M, 16C, and 16K (see FIG. 1) is configured to be mounted on the drawer unit 30.

4.1.1 Drawer Frame 31

The drawer frame 31 includes a first side frame 31A shown in FIG. 12 and a second side frame (not shown).

The side frame 31A extends in the moving direction. The first side frame 31A supports the plurality of gears 32Y, 32M, 32C, 32K, the plurality of wires 33Y, 33M, 33C, 33K, the plurality of first springs 34Y, 34M, 34C, 34K, the plurality of lock members 35Y, 35M, 35C, 35K, the plurality of second springs 36Y, 36M, 36C, 36K, and the plurality of pulleys 37Y, 37M, 37C, 37K.

The second side frame is located at the opposite side of the first side frame 31A with respect to the photosensitive drum 12Y in the axial direction. The second side frame is explained like the first side frame 31A. For this reason, a description of the second side frame will be omitted.

4.1.2 Gear

As shown in FIG. 12, the plurality of gears 32Y, 32M, 32C, 32K is attached to the side surface of the drawer frame 31. The plurality of gears 32Y, 32M, 32C, 32K is arranged in the moving direction. The plurality of gears 32Y, 32M, 32C, 32K is parts of the drawer unit 30 configured to contact the main housing 2. More specifically, the main housing 2 includes a plurality of rack gears 39Y, 39M, 39C, 39K.

The position of the lack gear 39M in the upper-lower direction is different from the position of the rack gear 39Y in the upper-lower direction. More specifically, the rack gear 39M is located at a position higher than the rack gear 39Y. The rack gear 39C is located at a position higher than the rack gear 39M. The rack gear 39K is located at a position higher than the rack gear 39C. When the rack gears 39Y, 39M, 39C, 39K are located at the positions being different from each other in the upper-lower direction, in comparison with a case in which the rack gears 39Y, 39M, 39C, 39K are located at positions being different from each other in the axial direction, the drawer unit 30 can be reduced in size in the axial direction, and, consequently, the image forming apparatus 1 can be reduced in size.

The plurality of gears 39Y, 39M, 39C, 39K extends in the moving direction. The gear 32Y rotates while being engaged with the rack gear 39Y while the drawer unit 30 moves between the internal position and the external position. More specifically, the gear 32Y is engaged with the rack gear 39Y while the drawer unit 30 moves from the internal position to the external position, and rotates in a direction to wind up the wire 33Y. The gear 32Y is engaged with the rack gear 39Y while the drawer unit 30 moves from the external position to the internal position, and rotates in a direction opposite from the direction to wind up the wire 33Y.

Figure 13:
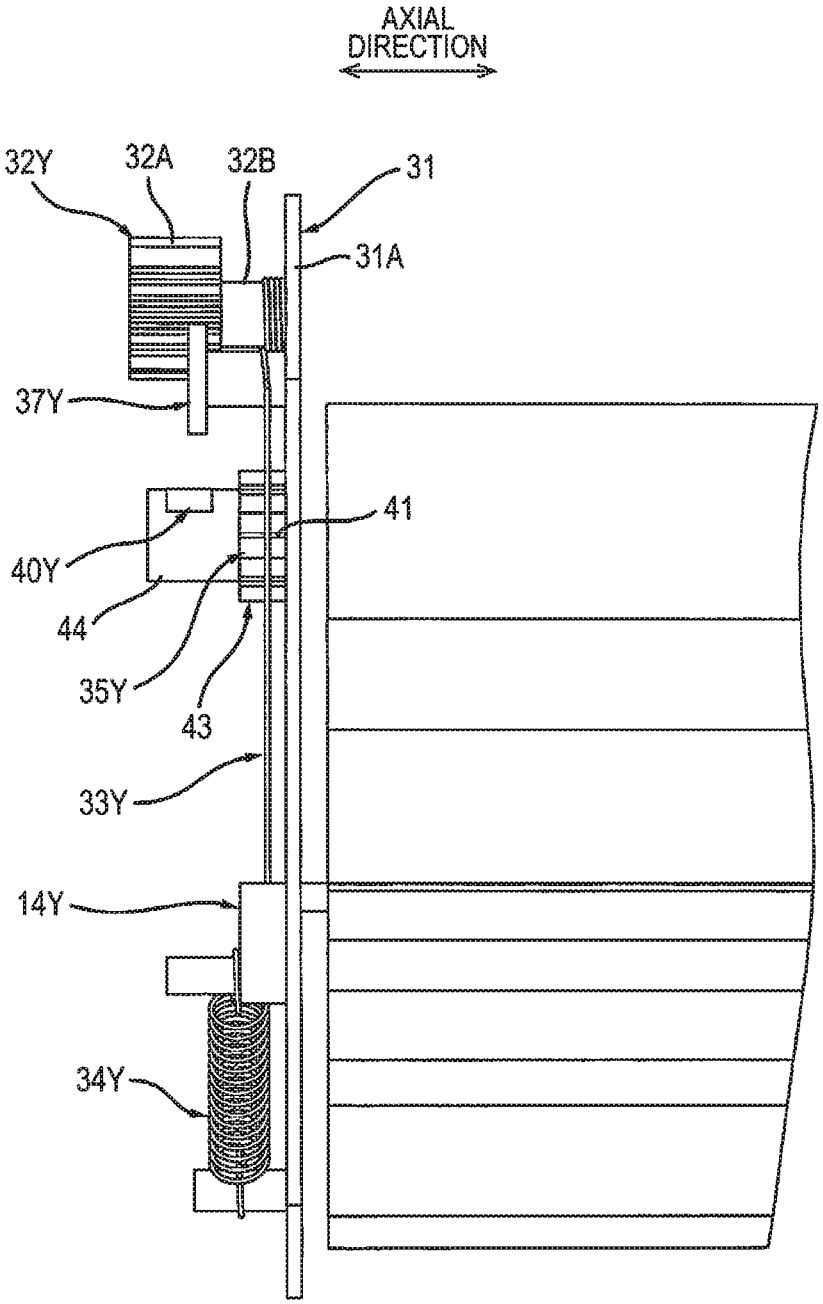
FIG. 13 is a front view of the drawer unit shown in FIG. 12.

As shown in FIG. 13, the gear 32Y has a plurality of gear teeth 32A and a shaft 32B. The plurality of gear teeth 32A is arranged in the rotating direction of the gear 32Y. The shaft 32B is located between the plurality of gear teeth 32A and the side surface of the drawer frame 31 in the axial direction. One end of the wire 33Y is attached to the shaft 32B. In this manner, when the gear 32Y rotates, the wire 33Y is wound up on the shaft 32B.

Each of the gears 32M, 32C, and 32K has the same structure as that of the gear 32Y, and is explained like the gear 32Y. For this reason, descriptions of the gears 32M, 32, and 32K will be omitted. More specifically, the gear 32M is engaged with the rack gear 39M and then rotates while the drawer unit 30 moves between the internal position and the external position.

4.1.3 Wire

The wire 33Y, as shown in FIG. 12, connects the gear 32Y to the exposure head 14Y. More specifically, one end of the wire 33Y is attached to the gear 32Y. The other end of the wire 33Y is attached to the exposure head 14Y. The wire 33M connects the gear 32M to the exposure head 14M, the wire 33C connects the gear 32C to the exposure head 14C, and the wire 33K connects the gear 32K to the exposure head 14K.

The wire 33Y is wound up on a shaft 32B (see FIG. 13) of the gear 32Y by the rotation of the gear 32Y when the drawer unit 30 moves from the internal position to the external position. When the wire 33Y is wound up, the exposure head 14Y moves from the first adjacent position (see FIG. 12) to the first spaced position (see FIG. 14). More specifically, while the drawer unit 30 moves from the internal position to the external position, the wire 33Y contacts the gear 32Y to move the exposure head 14Y. The wire 33Y is a moving member, and the drawer frame 31 includes the moving member. More specifically, the gear 32Y serving as a part of the drawer unit 30 configured to contact the main housing 32 moves the exposure head 14Y through the wire 33Y serving as the moving member.

More specifically, the drawer frame 31 has a plurality of exposure head guides 38Y, 38M, 38C, 38K. The exposure head guide 38Y guides the movement of the exposure head 14Y. The exposure head guide 38M guides the movement of the exposure head 14M. The exposure head guide 38C guides the movement of the exposure head 14C. The exposure head guide 38K guides the movement of the exposure head 14K. The plurality of exposure head guides 38Y, 38M, 38C, 38K extends in the upper-lower direction. When the wire 33Y is wound up, the exposure head 14Y is guided by the exposure head guide 38Y and moves from the first adjacent position (see FIG. 12) to the first spaced position (see FIG. 14).

The exposure head 14M is configured to move between a second adjacent position (see FIG. 12) at which the exposure head 14M is adjacent to the photosensitive drum 12M and a second spaced position (see FIG. 14) at which the exposure head 14M is farther spaced away from the exposure drum 12M than at the second adjacent position. When the wire 33M is wound up, the exposure head 14M is guided by the exposure head guide 38M and moves from the second adjacent position (see FIG. 12) to the second spaced position (see FIG. 14). The exposure head 14C moves between a third adjacent position (see FIG. 12) at which the exposure head 14C is adjacent to the photosensitive drum 12C and a third spaced position (see FIG. 14) at which the exposure head 14C is farther spaced away from the photosensitive drum 12C than at the third adjacent position. When the wire 33C is wound up, the exposure head 14C is guided by the exposure head guide 38C and moves from the third adjacent position (see FIG. 12) to the third spaced position (see FIG. 14). The exposure head 14K moves between a fourth adjacent position (see FIG. 12) at which the exposure head 14K is adjacent to the photosensitive drum 12K and a third spaced position (see FIG. 14) at which the exposure head 14K is farther spaced away from the photosensitive drum 12K than at the fourth adjacent position. When the wire 33K is wound up, the exposure head 14K is guided by the exposure head guide 38K and moves from the fourth adjacent position (see FIG. 12) to the fourth spaced position (see FIG. 14).

4.1.4 First Spring

Figure 14:
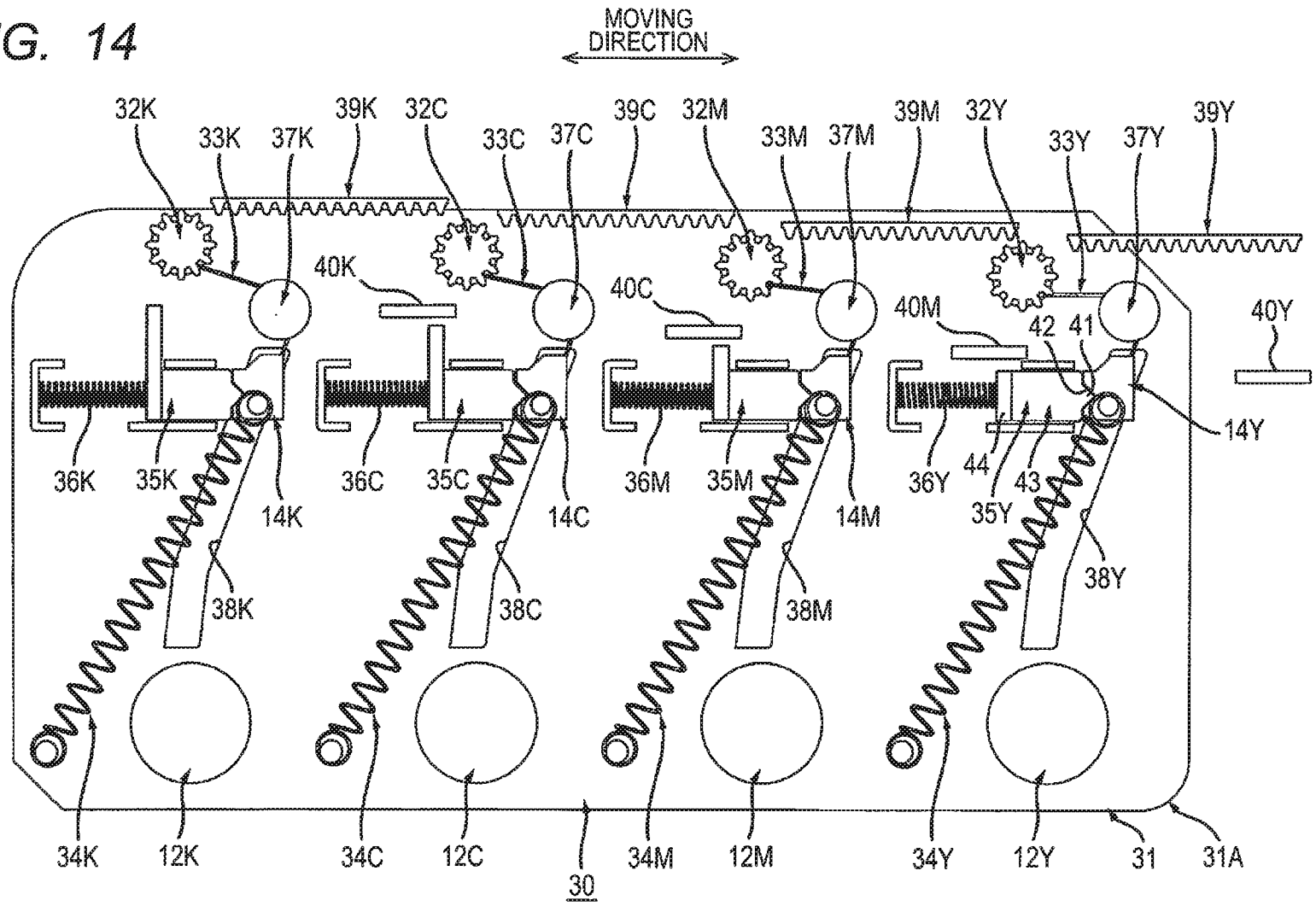
FIG. 14 shows a state where the drawer unit shown in FIG. 12 is located at the external position, the exposure head is located at the first spaced position, and the lock member is located at a lock position.

The first spring 34Y, as shown in FIG. 14, draws the exposure head 14Y located at the first spaced position toward the first adjacent position. In this manner, when the gear 32Y rotates in a direction opposite from a direction in which the wire 33Y is wound up, the exposure head 14Y is drawn by the first spring 34Y and moves from the first spaced position to the first adjacent position. The first spring 34Y is a coil spring, for example. One end of the first spring 34 is attached to the exposure head 14Y. The other end of the first spring 34Y is attached to the drawer frame 31.

The first spring 34M draws the exposure head 14M located at the second spaced position toward the second adjacent position. The first spring 34C draws the exposure head 14C located at the third spaced position toward the third adjacent position. The first spring 34K draws the exposure head 14K located at the fourth spaced position toward the fourth adjacent position. Each of the first springs 34M, 34C, 34K has the same structure as that of the first spring 34Y, and is explained like the first spring 34Y. For this reason, descriptions of the first springs 34M, 34C, 34K will be omitted.

4.1.5 Lock Member

The lock member 35Y, as shown in FIG. 12 and FIG. 14, is configured to move between a lock position (see FIG. 14) at which the exposure head 14Y is locked at the first spaced position and a lock release position (see FIG. 12) at which the exposure head 14Y is unlocked. The lock member 35Y is configured to slidably move in the moving direction between the lock position and the lock release position. The lock member 35Y moves from the lock release position to the lock position while the drawer unit 30 moves from the internal position (see FIG. 12) to the external position (see FIG. 14). The lock member 35Y moves from the lock position to the lock release position while the drawer unit 30 moves from the external position to the internal position.

The lock member 35Y extends in the moving direction. The lock member 35Y has one end and the other end in the moving direction. The lock member 35Y has a protrusion 41. The protrusion 41 is located at one end of the lock member 35Y. The protrusion 41 is fitted in a concave part 42 of the exposure head 14Y located at the first spaced position in a state where the lock member 35Y is located at the lock position. In this manner, the lock member 35Y locks the exposure head 14Y at the first spaced position. When the exposure head 14Y is locked at the first spaced position, the exposure head 14Y is prevented from returning to the first adjacent position when the drawer unit 30 is located at the external position.

When the lock member 35Y is located at the lock position, the lock member 35Y contacts the protrusion 40Y in the main housing 2 while the drawer unit 30 moves from the external position (see FIG. 14) to the internal position (see FIG. 12). More specifically, the main housing 2 includes the protrusion 40Y, and the protrusion 40Y contacts the lock member 35Y located at the lock position when the drawer unit 30 moves from the external position to the internal position. The lock member 35Y moves from the lock position to the lock release position in a state where the lock member 35Y contacts the protrusion 40Y when the drawer unit 30 moves from the external position to the internal position. The lock member 35Y, as shown in FIG. 12, has a main part 43 and a contact part 44. The main part 43 has the protrusion 41. The contact part 44 contacts the protrusion 40Y while the drawer unit 30 moves from the external position (see FIG. 14) to the internal position (see FIG. 12). The contact part 44, as shown in FIG. 13, protrudes from the main part 43 in the axial direction. The protrusion 40Y is located at a position different from the position of the main body 43 in the axial direction in a state where the drawer unit 30 is located at the internal position. The protrusion 40Y is arranged at an interval from the main part 43 in the axial direction in a state where the drawer unit 30 is located at the internal position. More specifically, the protrusion 40Y contacts the contact part 44 without contacting the main part 43 while the drawer unit 30 moves from the external position (see FIG. 14) to the internal position (see FIG. 12).

As shown in FIG. 12 and FIG. 14, the main housing 2 further includes protrusions 40M, 40C, and 40K. The protrusion 40M contacts the lock member 35M located at the lock position when the drawer unit 30 moves from the external position to the internal position. The protrusion 40C contacts the lock member 35C located at the lock position when the drawer unit 30 moves from the external position to the internal position. The protrusion 40K contacts the lock member 35K located at the lock position when the drawer unit 30 moves from the external position to the internal position.

Each of the lock members 35M, 35C, 35K has the same structure as that of the lock member 35Y, and is explained like the lock member 35Y. Descriptions of the lock members 35M, 35C, 35K will be omitted.

4.1.6 Second Spring

The second spring 36Y, as shown in FIG. 12, presses the lock member 35Y located at the lock release position toward the lock position (see FIG. 14). In this manner, the lock member 35Y moves from the lock release position to the lock position when the drawer unit 30 moves from the internal position to the external position. The second spring 36Y contacts the other end of the lock member 35Y. The second spring 36Y is a coil spring.

Each of the second springs 36M, 36C, 36K has the same structure as that of the second spring 36Y, and is explained like the second spring 36Y. For this reason, descriptions of the second springs 36M, 36C, 36K will be omitted.

4.1.7 Pulley

The pulley 37Y, as shown in FIG. 12, is arranged at an interval from the gear 32Y in the moving direction. The pulley 37Y is located above the exposure head 14Y. The pulley 37Y is located above the exposure head guide 38Y. The pulley 37Y contacts the wire 33Y. The wire 33Y extends in the moving direction between the gear 32Y and the pulley 37Y and extends in the upper-lower direction between the pulley 37Y and the exposure head 14Y.

Each of the pulleys 37M, 37C, 37K has the same structure as that of the pulley 37Y, and is explained like the pulley 37Y. For this reason, descriptions of the pulleys 37M, 37C, and 37K will be omitted. The wire 33M contacts the pulley 37M.

The distance between the exposure head 14Y located at the first adjacent position and the pulley 37Y is equal to the distance between the exposure head 14M located at the second adjacent position and the pulley 37M. In this manner, the moving distance of the exposure head 14Y is made equal to the moving distance of the exposure head 14M. Note that the distance between the exposure head 14C located at the third adjacent position and the pulley 37C and the distance between the exposure head 14K located at the fourth adjacent position and the pulley 37K are equal to the distance between the exposure head 14M located at the second adjacent position and the pulley 37M, respectively.

4.2 Operations and Effects of Second Embodiment

According to the second embodiment, as shown in FIG. 12 and FIG. 14, the gear 32Y is engaged with the rack gear 39Y of the main housing 2 and then rotates, and the rotating gear 32Y winds up the wire 33Y to move the exposure head 14Y.

More specifically, the gear 32Y serving as a part of the drawer unit 30 other than the exposure head 14Y contacts the rack gear 39Y of the main housing 2 to move the exposure head 14Y.

For this reason, in comparison with a case in which the exposure head 14Y itself contacts the main housing 2, an impact occurring when the exposure head 14Y contacts the main housing 2 can be suppressed from being transmitted to the exposure head 14Y.

5. Third Embodiment

A third embodiment will be described with reference to FIG. 15 and FIG. 16.

5.1 Details of Drawer Unit

Figure 15:
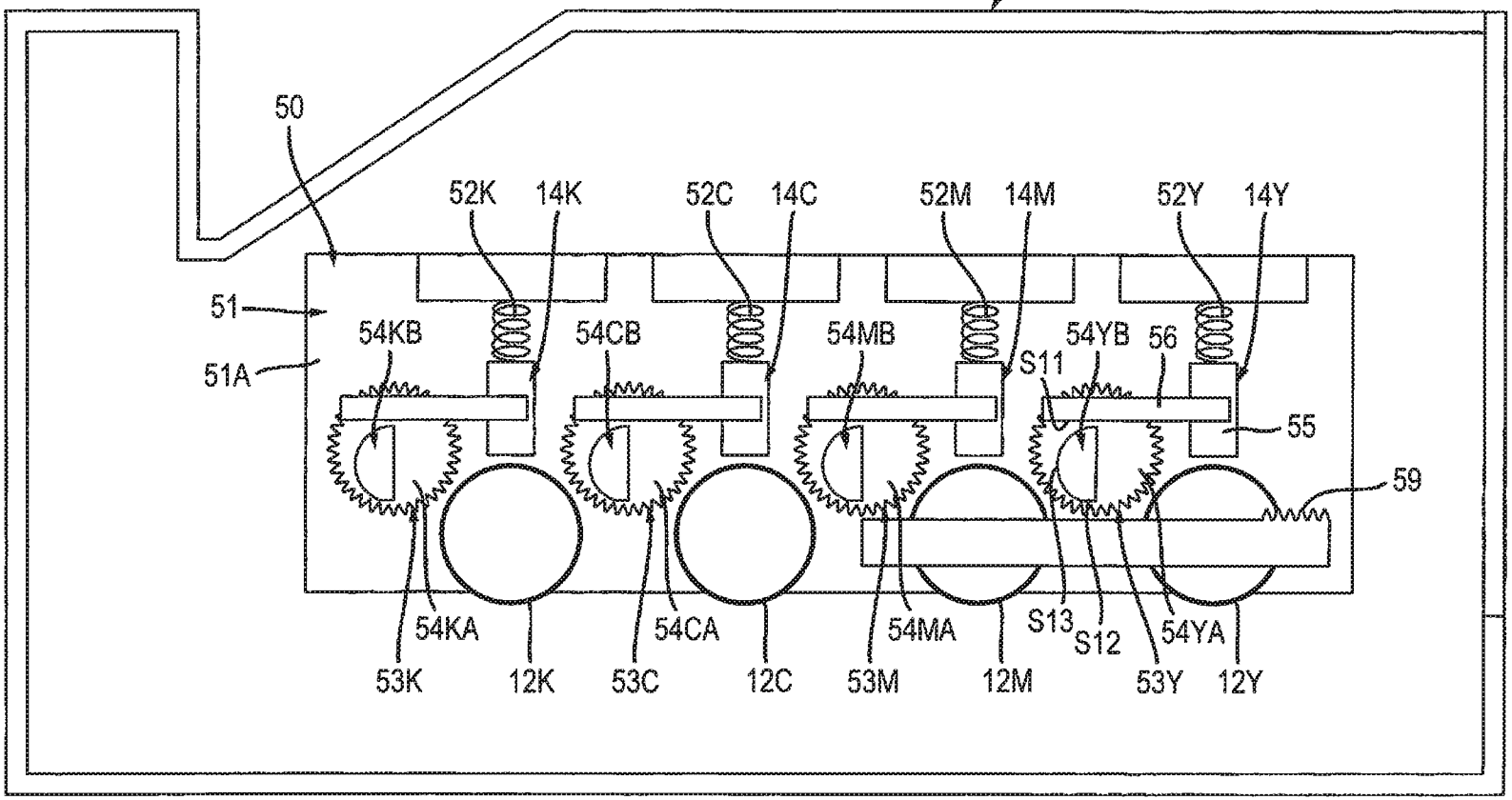
FIG. 15 is a schematic diagram of an image forming apparatus according to a third embodiment, and shows a state where a drawer unit is located at an internal position and a cam is located at a pressing release position.

As shown in FIG. 15, a drawer unit 50 includes, in addition to the plurality of exposure heads 14Y, 14M, 14C, 14K, a drawer frame 51, a plurality of springs 52Y, 52C, 52K, and a plurality of gears 53Y, 53M, 53C, 53K. Like in the drawer unit 4 (see FIG. 1) described above, the drum cartridges 16Y, 16M, 16C, 16K (see FIG. 1) are configured to be mounted on the drawer unit 50.

5.1.1 Drawer Frame

The drawer frame 51, as in the first embodiment, includes a first side frame 51A shown in FIG. 15 and a second side frame (not shown).

The first side frame 51A extends in the moving direction. The first side frame 51A, like the first side frame 27 (see FIG. 4) according to the first embodiment, has a space in its inside. The first side frame 51A contains a plurality of gears 53Y, 53M, 53C, and 53K.

The second side frame is located at the opposite side of the first side frame 51A with respect to the photosensitive drum 12Y in the axial direction. The second side frame is explained like the first side frame. For this reason, a description of the second side frame will be omitted.

5.1.2 Spring

The spring 52Y presses the exposure head 14Y from the first spaced position (see FIG. 16) to the first adjacent position (see FIG. 15). The spring 52Y is a coil spring. The spring 52Y contacts the exposure head 14Y.

Each of the springs 52M, 52C, and 52K has the same structure as that of the spring 52Y, and is explained like the spring 52Y. For this reason, descriptions of the springs 52M, 52C, and 52K will be omitted.

5.1.3 Gear

The plurality of gears 53Y, 53M, 53C, 53K is arranged in the moving direction. The plurality of gears 53Y, 53M, 53C, 53K is arranged at an interval from each other. The plurality of gears 53Y, 53M, 53C, 53K engages a rack gear 59 and then rotates while the drawer unit 50 moves between the internal position (see FIG. 15) and the external position (see FIG. 16). More specifically, the main housing 2 has one rack gear 59. The plurality of gears 53Y, 53M, 53C, 53K engages the rack gear 59 and then rotates in the order of the gears 53Y, 53M, 53C, 53K while the drawer unit 50 moves from the internal position to the external position. The plurality of gears 53Y, 53M, 53C, 53K engages the rack gear 59 and then rotates in the order of the gears 53K, 53C, 53M, 53Y while the drawer unit 50 moves from the external position to the internal position. The gear 53Y has a main part 54YA and a cam 54YB.

The cam 54YB protrudes from the side surface of the main part 54YA in the axial direction. The cam 54YB is configured to rotate together with the main part 54YA. The cam 54YB is configured to move between a pressing position (see FIG. 16) and a pressing release position (see FIG. 15).

The cam 54YB moves to the pressing position due to rotation of the gear 53Y while the drawer unit 50 moves from the internal position to the external position. The cam 54YB, as shown in FIG. 16, when being located at the pressing position, causes the exposure head 14Y to be located at the first spaced position.

The cam 54YB moves to the pressing release position due to rotation of the gear 53Y while the drawer unit 50 moves from the external position to the internal position. The cam 54YB, as shown in FIG. 15, when being located at the pressing release position, stops pressing against the exposure head 14Y.

More specifically, the exposure head 14Y has an exposure frame 55 and a bar 56 extending from the exposure frame 55. The bar 56 has a first flat surface S11. More specifically, the exposure head 14Y has the first flat surface S11. The first flat surface S11, more specifically, is a lower surface of the bar 56. The first flat surface S11 is configured to contact the cam 54YB located at the pressing position.

The cam 54YB has a semi-circular shape. The cam 54YB has a second flat surface S12 and an arc-like surface S13. When the cam 54YB is located at the pressing position, the second flat surface S12 contacts the first flat surface S11 of the exposure head 14Y. In this manner, when the cam 54YB is located at the pressing position, the exposure head 14Y is fixed at the first spaced position. When the exposure head 14Y is fixed at the first spaced position, the exposure head 14Y is prevented from returning to the first adjacent position when the drawer unit 50 is located at the external position.

The arc-like surface S13 contacts the first flat surface S11 of the exposure head 14Y while the cam 54YB moves from the pressing release position to the pressing position. In this manner, while the cam 54YB moves from the pressing release position to the pressing position, the exposure head 14Y moves from the first adjacent position to the first spaced position. More specifically, the gear 53Y serving as a part of the drawer unit 50 configured to contact the main housing 2 moves the exposure head 14Y.

5.2 Operations and Effects of Third Embodiment

Figure 16:
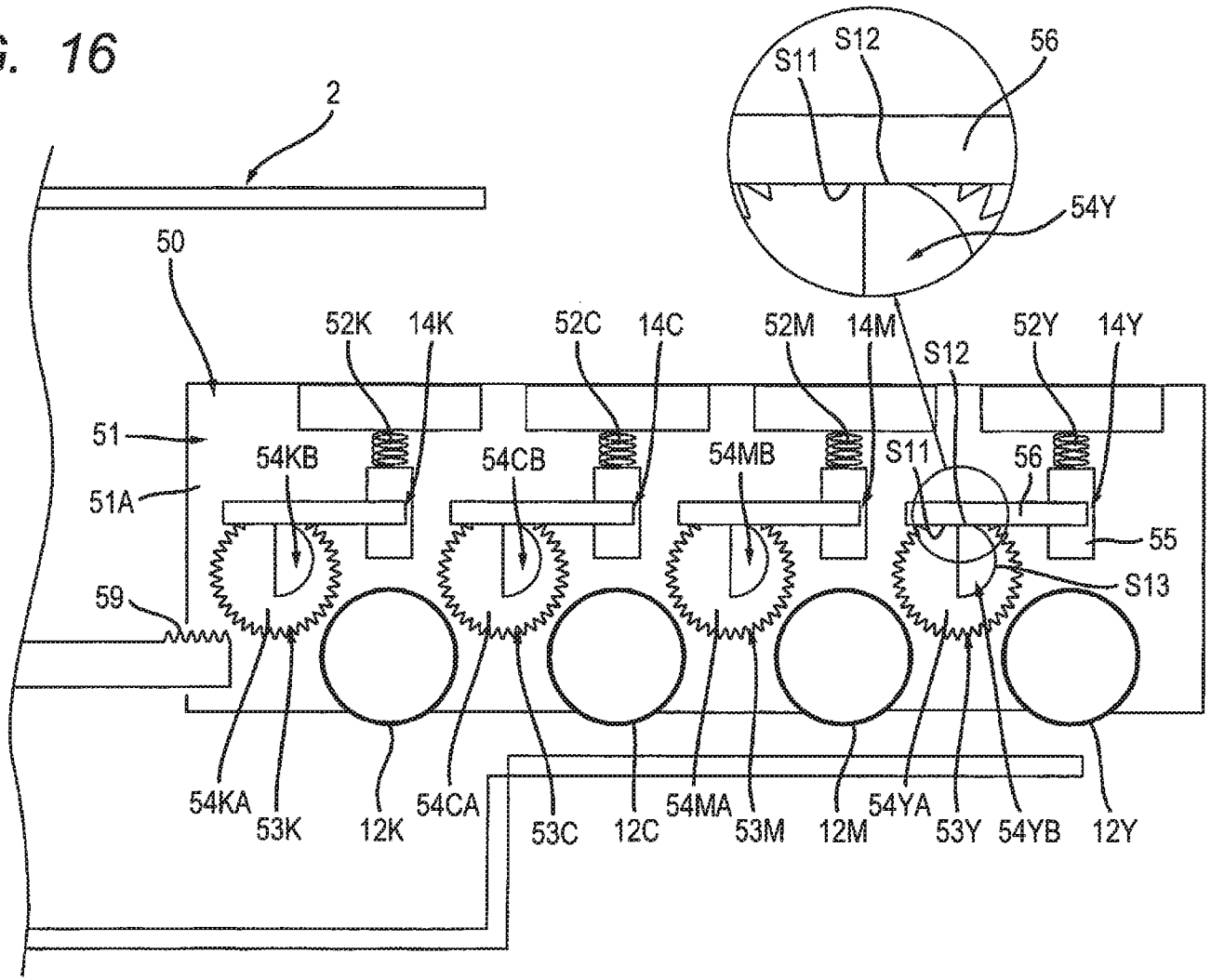
FIG. 16 shows a state where the drawer unit shown in FIG. 15 is located at an external position and the cam is located at a pressing position.

According to the third embodiment, as shown in FIG. 15 and FIG. 16, the gear 53Y engages the rack gear 59 of the main housing 2 and then rotates, and the cam 54YB disposed on the gear 53Y presses the bar 56 of the exposure head 14Y to move the exposure head 14Y.

More specifically, the gear 53Y serving as a part of the drawer unit 50 other than the exposure head 14Y contacts the second rack gear 59 of the main housing 2 to move the exposure head 14Y.

For this reason, in comparison with a case in which the exposure head 14Y itself contacts the main housing 2, an impact occurring when the exposure head 14Y contacts the main housing 2 can be suppressed from being transmitted to the exposure head 14Y.

6. Fourth Embodiment

A fourth embodiment will be described with reference to FIG. 17 to FIG. 24.

6.1 Details of Drawer Unit

Figure 17:
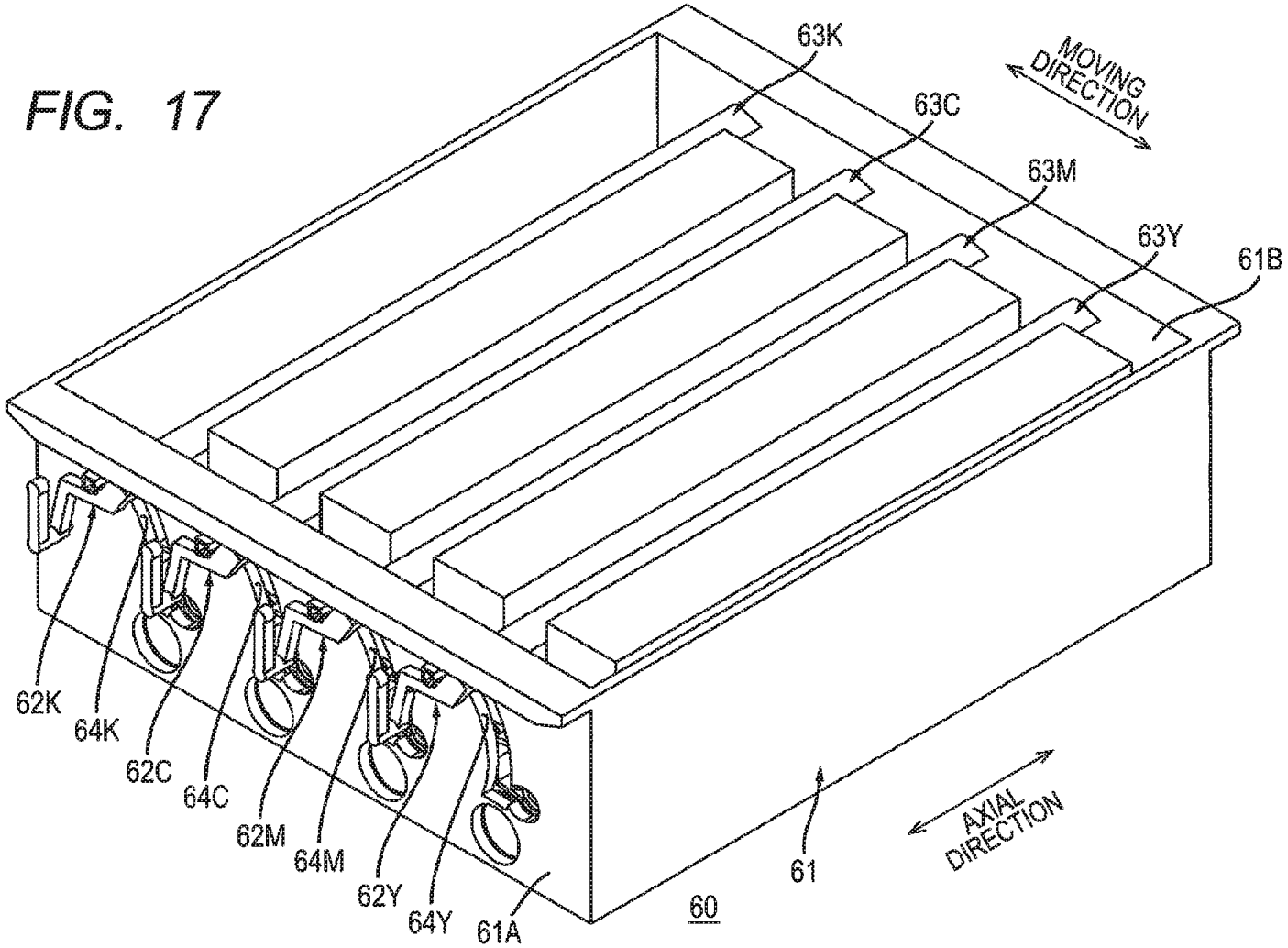
FIG. 17 is a perspective view of a drawer unit according to a fourth embodiment.

As shown in FIG. 17, a drawer unit 60 includes a drawer frame 61, a plurality of levers 62Y, 62M, 62C, 62K, and a plurality of covers 63Y, 63M, 63C, 63K.

The drawer unit 60 includes the plurality of exposure heads 14Y, 14M, 14C, 14K (see FIG. 18) described above. Like the drawer unit 4 (see FIG. 1), a plurality of drum cartridges 16Y, 16M, 16C, 16K (see FIG. 1) is configured to be mounted on the drawer unit 60.

6.1.1 Drawer Frame

Figure 18:
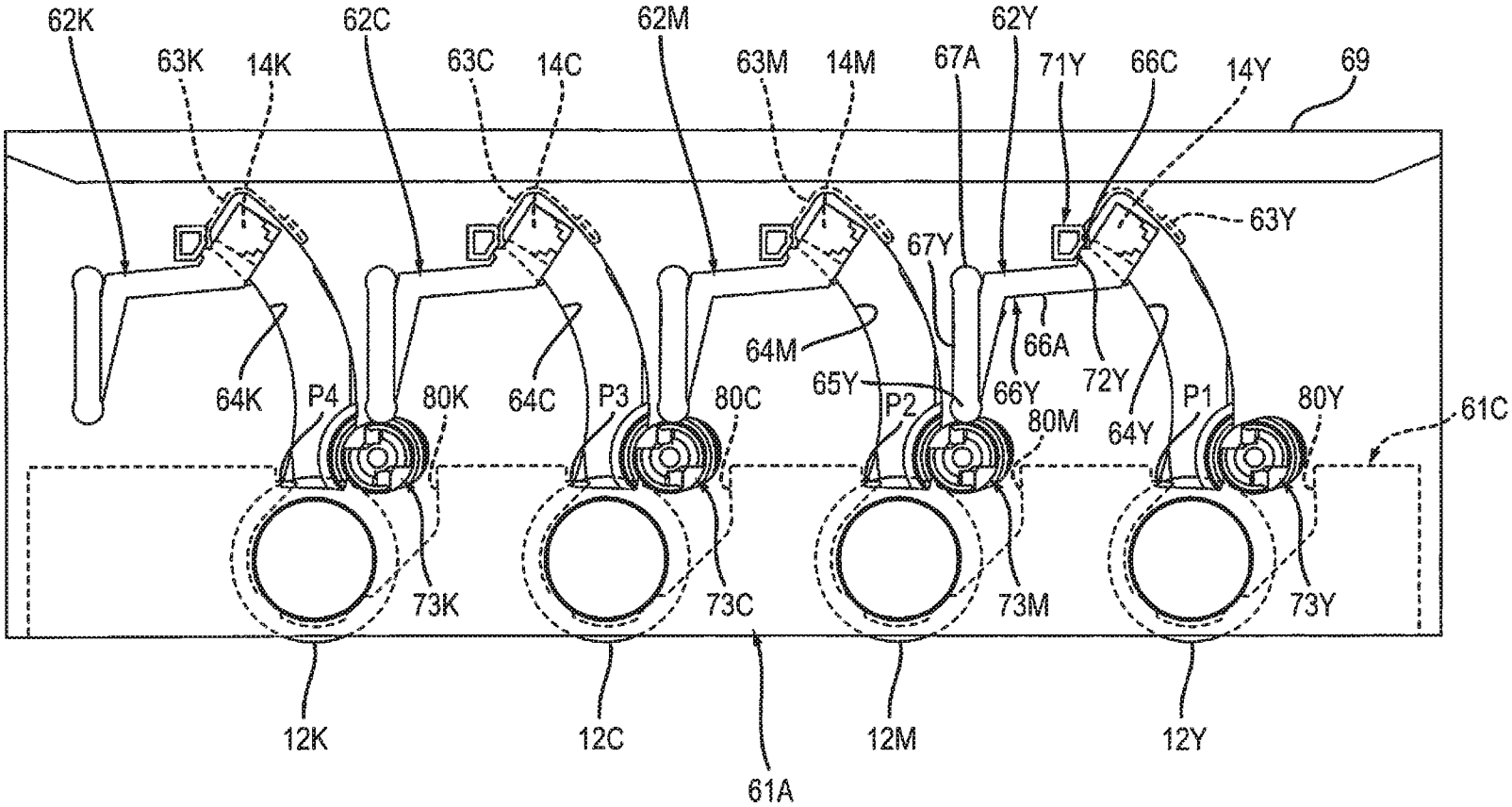
FIG. 18 is a side view of the drawer unit shown in FIG. 17, and shows a state where the drawer unit is located at an external position and the exposure head is located at a first spaced position.

As shown in FIG. 17, the drawer frame 61 includes a first side plate 61A, a second side plate 61B, and a metal plate 61C (see FIG. 18). That is, the drawer unit 60 has the metal plate 61C.

As shown in FIG. 18, the first side plate 61A extends in the moving direction. The first side plate 61A supports the levers 62Y, 62M, 62C, 62K. The first side plate 61A has a plurality of grooves 64Y, 64M, 64C, 64K. The groove 64Y allows the lever 62Y to move between a first position and a second position. The first position and the second position will be described later. The groove 64Y extends in the rotating direction of the lever 62Y. Each of the grooves 64M, 64C, 64K has the same structure as that of the groove 64Y, and is explained like the groove 64Y. For this reason, descriptions of the grooves 64Y, 64C, 64K will be omitted.

As shown in FIG. 17, the second side plate 61B is located at the opposite side of the first side plate 61A in the axial direction with respect to the photosensitive drum 12Y. The second side plate 61B is explained like the first side plate 61A. For this reason, a description of the second side plate 61B will be omitted.

Figure 19:
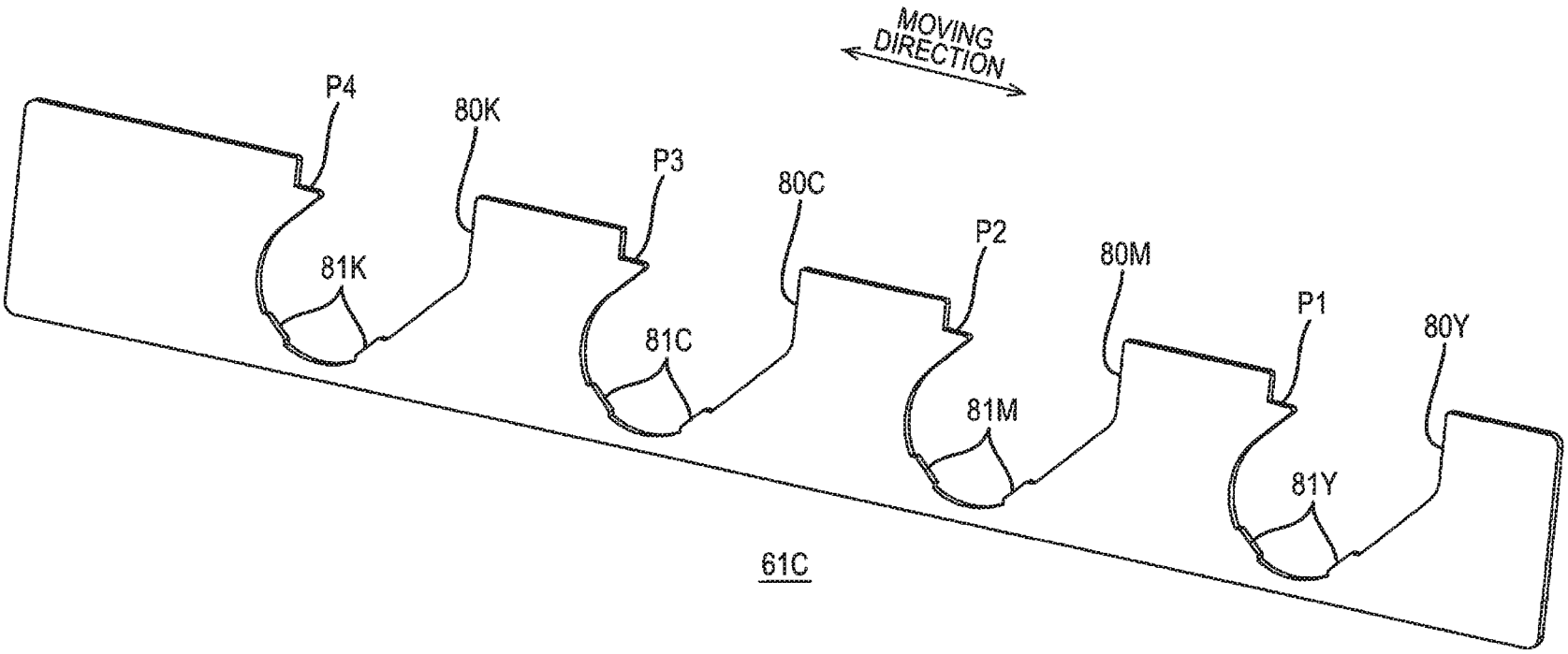
FIG. 19 is a perspective view of a metal plate shown in FIG. 17.

As shown in FIG. 18, the metal plate 61C extends in the moving direction. The plurality of photosensitive drums 12Y, 12M, 12C, 12K is fixed to the metal plate 61C in a state where the plurality of drum cartridges 16Y, 16M, 16C, 16K is mounted on the drum unit 60. More specifically, as shown in FIG. 19, the metal plate 61C has a plurality of grooves 80Y, 80M, 80C, 80K, two protrusions 81Y, two protrusions 81M, two protrusions 81C, and two protrusions 81K.

The plurality of grooves 80Y, 80M, 80C, 80K is arranged at intervals in the moving direction. An end of the photosensitive drum 12Y (see FIG. 18) is fitted in the groove 80Y when the drum cartridge 16Y is mounted on the drum unit 60. The groove 80Y extends in the upper-lower direction. Each of the grooves 80M, 80C, 80K has the same shape as that of the groove 80Y, and is explained like the groove 80Y. For this reason, descriptions of the groove 80M, 80C, 80K will be omitted.

Figure 21:
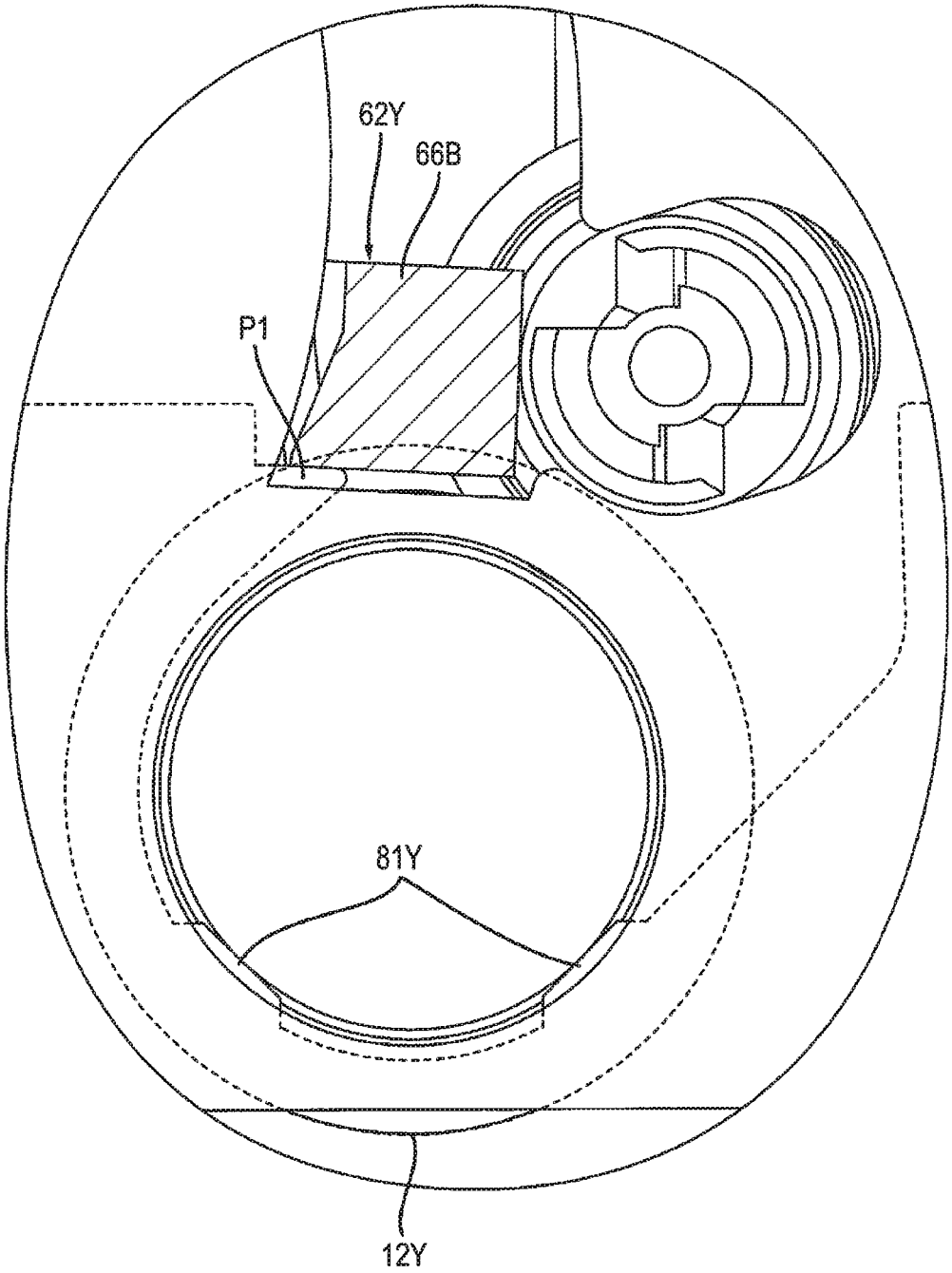
FIG. 21 is a partial enlarged view of FIG. 20.

The two protrusions 81Y are located at the lower end of the groove 80Y. Each of the two protrusions 81Y is located in the groove 80Y. Each of the two protrusions 81Y, as shown in FIG. 21, contacts an end of the photosensitive drum 12Y in a state where the drum cartridge 16Y is mounted on the drum unit 60. In this manner, the photosensitive drum 12Y is fixed to the metal plate 61C in a state where the drum cartridge 16Y is mounted on the drum unit 60. Each of the two protrusions 81Y protrudes toward the end of the photosensitive drum 12Y in the radial direction of the photosensitive drum 12Y in a state where the drum cartridge 16Y is mounted on the drum unit 60. The two protrusions 81Y are arranged at an interval from each other in the rotating direction of the photosensitive drum 12Y in a state where the drum cartridge 16Y is mounted on the drum unit 60. As shown in FIG. 19, the two protrusions 81M, the two protrusions 81C, and the two protrusions 81K have the same shapes as those of the two protrusions 81Y, respectively, and are explained like the two protrusions 81Y. For this reason, descriptions of the two protrusions 81M, the two protrusions 81C, and the two protrusions 81K will be omitted.

The metal plate 61C has a plurality of parts P1, P2, P3, and P4. The plurality of parts P1, P2, P3, and P4 is located at the upper end of the metal plate 61C. The plurality of parts P1, P2, P3, and P4 is arranged at an interval from each other in the moving direction. The plurality of parts P1, P2, P3, and P4 extends in the moving direction. The part P1 is located above the two protrusions 81Y. The part P1 is located on the lower end in the groove 64Y (see FIG. 18) when viewed in the axial direction. The part P2 is located above the two protrusions 81M. The part P2 is located on the lower end in the groove 64M (see FIG. 18) when viewed in the axial direction. The part P3 is located above the two protrusions 81C. The part P3 is located on the lower end in the groove 64C (see FIG. 18) when viewed in the axial direction. The part P4 is located above the two protrusions 81K. The part P4 is located in the lower end of the groove 64K (see FIG. 18) when viewed in the axial direction.

6.1.2 Lever

Figure 22:
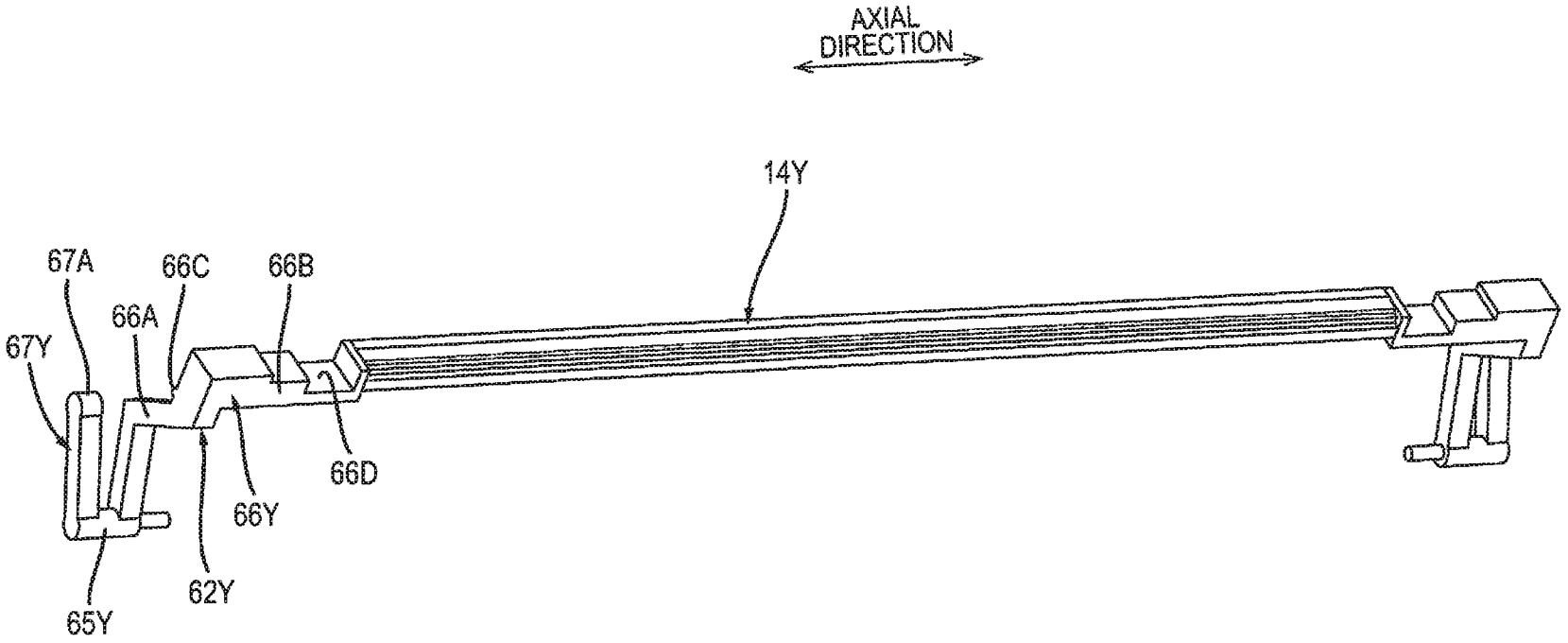
FIG. 22 is a perspective view of a lever and the exposure head.

As shown in FIG. 17, the lever 62Y is located at the opposite side of the exposure head 14Y with respect to the first side plate 61A in the axial direction. The lever 62Y is connected to the exposure head 14Y (see FIG. 22) through the groove 64Y of the first side plate 61A. The lever 62Y is supported by the first side plate 61A. The lever 62Y is configured to rotatably move with respect to the first side plate 61A. The lever 62Y is configured to rotatably move between a first position (see FIG. 20) at which the exposure head 14Y is located at the first adjacent position and a second position (see FIG. 18) at which the exposure head 14Y is located at the first spaced position. As shown in FIG. 22, the lever 62Y has a rotating shaft 65Y, a first rod 66Y, and a second rod 67Y.

The rotating shaft 65Y is supported by the first side plate 61A. The rotating shaft 65Y is configured to rotate with respect to the first side plate 61A. In this manner, the lever 62Y is configured to rotatably move with respect to the first side plate 61A. The rotating shaft 65Y extends in the axial direction. More specifically, the direction in which the rotating shaft 65Y extends is the axial direction. The rotating shaft 65Y has a columnar shape.

The first rod 66Y is connected to the exposure head 14Y. More specifically, the first rod 66Y has a first part 66A, a second part 66B, a protrusion 66C, and a concave part 66D. That is, the lever 62Y has the concave part 66D.

The first part 66A is located at the opposite side of the exposure head 14Y in the axial direction with respect to the first side plate 61A (see FIG. 17). The first part 66A extends in the radial direction of the rotating shaft 65Y. The first part 66A extends along the first side plate 61A. The first part 66A is connected to the rotating shaft 65Y.

The second part 66B passes through the groove 64Y (see FIG. 17) of the first side plate 61A. The second part 66B extends from the first part 66A. The second part 66B extends in the axial direction. The second part 66B is connected to the exposure head 14Y. The second part 66B, as shown in FIG. 21, contacts the metal plate 61C when the lever 62Y is located at the first position. More specifically, the lever 62Y contacts the metal plate 61C when the lever 62Y is located at the first position. In this manner, the lever 62Y is positioned at the first position. Since the lever 62Y is positioned at the metal plate 61C to which the photosensitive drum 12Y is fixed, positioning accuracy of the exposure head 14Y with respect to the photosensitive drum 12Y can be improved.

As shown in FIG. 18, the protrusion 66C is provided on the first part 66A. The protrusion 66C contacts the protrusion 71Y of the first side plate 61A when the lever 62Y is located at the second position. In this manner, the protrusion 66C has an arc-like shape when viewed in the axial direction. The protrusion 71Y of the first side plate 61A is located at the opposite side of the exposure head 14Y with respect to the first side plate 61A. The protrusion 71Y extends from the first side plate 61A. The protrusion 71Y extends in the axial direction. The protrusion 71Y has a square-column shape. The protrusion 71Y has a flat surface 72Y. The protrusion 66C contacts the flat surface 72 of the protrusion 71Y when the lever 62Y is located at the second position.

Figure 23:
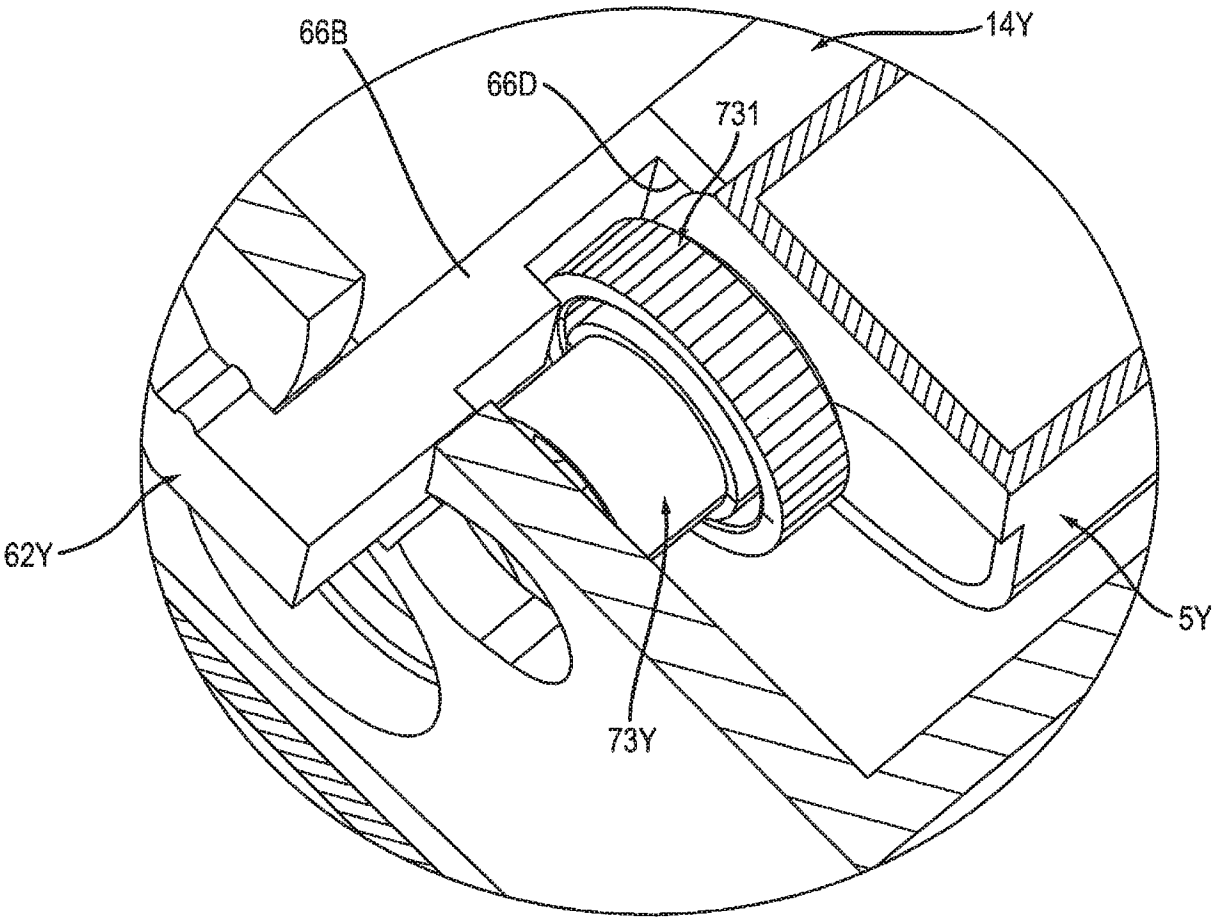
FIG. 23 shows a state where the exposure head is located at the first adjacent position and gear teeth of a coupling is fitted in a concave part of the lever.

The concave part 66D, as shown in FIG. 23, is provided on the second part 66B. A coupling 73Y of the development cartridge 5Y is fitted in the concave part 66D when the lever 62Y is located at the first position. More specifically, the development cartridge 5Y has the coupling 73Y. A main coupling (not shown) provided in the main housing 2 is fitted in the coupling 73Y in a state where the drawer unit 60 on which the development cartridge 5Y is mounted is located at an internal position. In this manner, the coupling 73Y is configured to rotate together with the main coupling. The coupling 73Y is located on the side surface of the development cartridge 5Y. The coupling 73Y extends in the axial direction. The coupling 73Y has a cylindrical shape. The coupling 73Y has a plurality of gear teeth 731. The second part 66B of the lever 62Y and the coupling 73Y are arranged in the moving direction when the lever 62Y is located at the first position. At this time, the gear teeth 731 of the coupling 73Y are fitted in the concave part 66D. In this manner, when the lever 62Y is located at the first position, the second part 66B of the lever 62Y is prevented from contacting the coupling 73Y. Since the lever 62Y and the development cartridge 5Y are arranged to be close to each other, the drawer unit 60 can be reduced in size, and the image forming apparatus 1 can be reduced in size.

Figure 20:
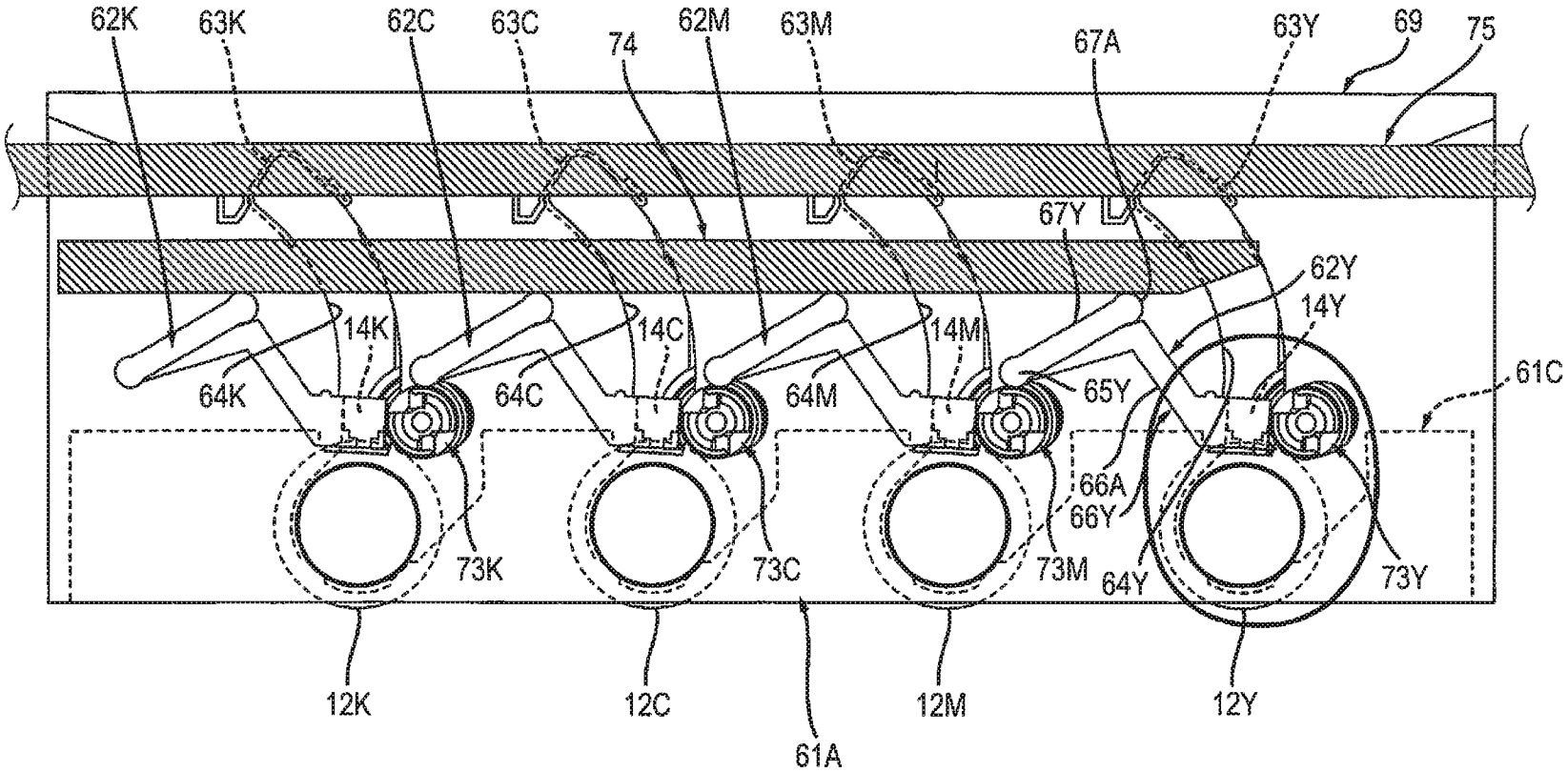
FIG. 20 is a side view of the drawer unit shown in FIG. 17, and shows a state where the drawer unit is located at an internal position and the exposure head is located at a first adjacent position.

As shown in FIG. 20, when the drawer unit 60 is located at the internal position, the second rod 67Y contacts the protrusion 74 provided in the main housing 2. That is, the second rod 67Y contacts the main housing 2. The second rod 67Y, as shown in FIG. 22, extends in the radial direction of the rotating shaft 65Y. The second rod 67Y is connected to the rotating shaft 65Y. The second rod 67Y is located at the opposite side of the first side plate 61A (see FIG. 18) with respect to the first rod 66Y in the axial direction. More specifically, the position of the second rod 67Y in a direction in which the rotating shaft 65Y extends is different from the position of the first rod 66Y in the direction in which the rotating shaft 65Y extends. The second rod 67Y has a contact surface 67A. The contact surface 67A contacts the protrusion 74 while the drawer unit 60 moves from the external position to the internal position. The contact surface 67A has an arc-like shape when viewed in the axial direction. Since the contact surface 67A has the arc-like shape, the lever 62Y can be smoothly moved when the contact surface 67A contacts the protrusion 74. The contact surface 67A is located at an interval below a rail 69 of the first side plate 61A in a state the lever 62Y is located at the second position (see FIG. 18). The entirety of the lever 62Y is located at an interval below the rail 69 of the first side plate 61A in a state the lever 62Y is located at the second position. The rail 69 protrudes from the first side plate 61A. The rail 69 extends in the moving direction. As shown in FIG. 20, the rail 69 contacts a rail 75 disposed in the main housing 2. The rail 69 is supported by the rail 75. The lever 62Y moves from the second position to the first position due to a contact of the protrusion 74 of the main housing 2 with the contact surface 67 of the second rod 67Y while the drawer unit 60 moves from the external position to the internal position. In this manner, the exposure head 14Y moves from the first spaced position to the first adjacent position. More specifically, the lever 62Y is a part of the drawer unit configured to contact the main housing 2 and moves the exposure head 14Y.

Figure 24:
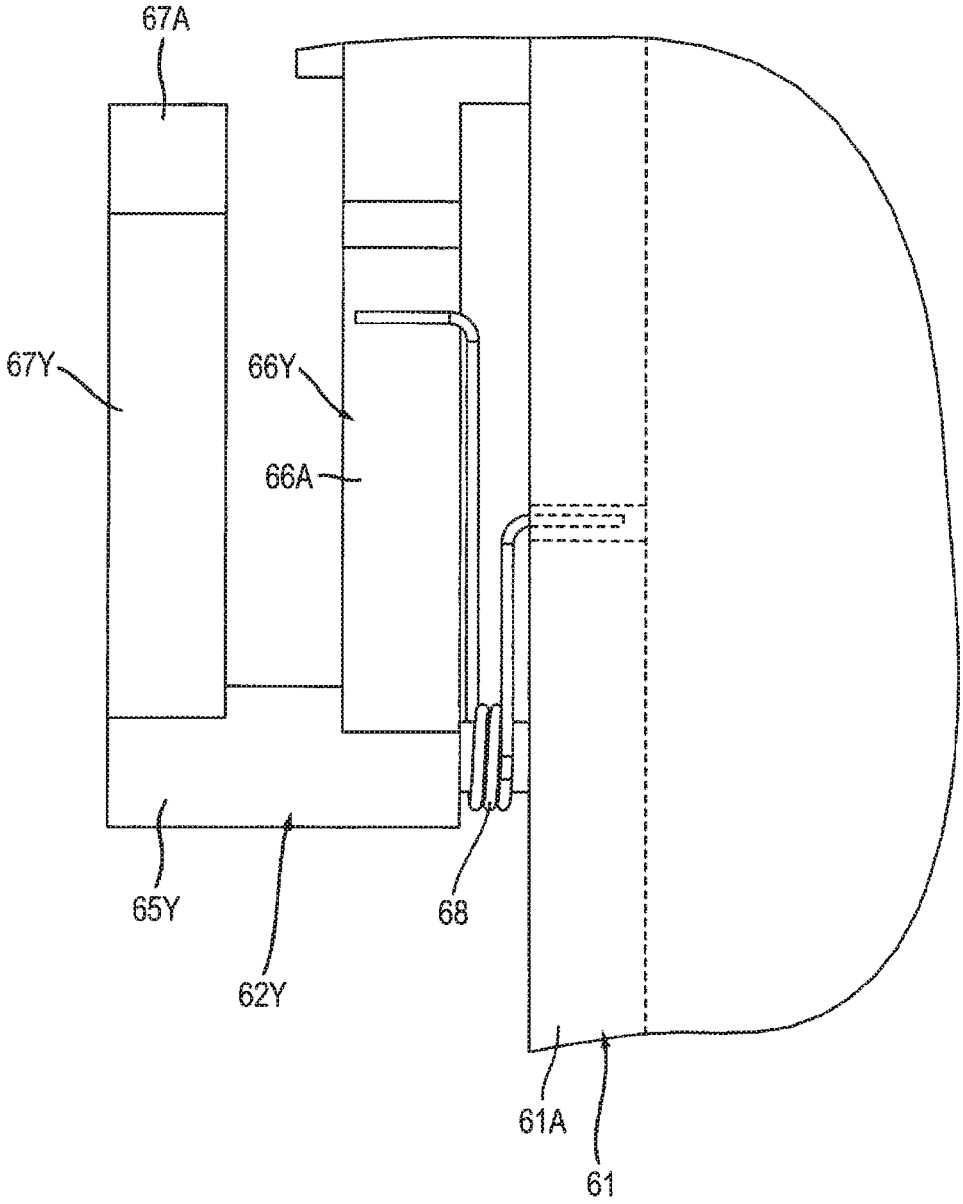
FIG. 24 is an explanatory diagram for illustrating a spring that presses the lever.

As shown in FIG. 24, the lever 62Y is pressed by a spring 68 from the first position to the second position. In this manner, the lever 62Y moves from the first position to the second position by pressing force of the spring 68 due to cancellation of a contact between the protrusion 74 of the main housing 2 and the second rod 67Y while the drawer unit 60 moves from the internal position to the external position. The spring 68 is, for example, a torsion spring. One end of the spring 68 is attached to the first side plate 61A. The other end of the spring 68 is attached to the first part 66A of the lever 62Y.

Each of the levers 62M, 62C, 62K has the same structure as that of the lever 62Y, and is explained like the lever 62Y. For this reason, descriptions of the levers 62M, 62C, 62K will be omitted.

6.1.3 Cover

As shown in FIG. 17 and FIG. 18, the cover 63Y covers the exposure head 14Y when the exposure head 14Y is located at the first spaced position. In this manner, the exposure head 14Y is protected in a state where the exposure head 14Y is located at the first spaced position when the drawer unit 60 is located at the external position. The cover 63Y extends in the axial direction. The cover 63Y extends from the first side plate 61A to the second side plate 61B. The cover 63Y is made of metal.

Each of the covers 63M, 63C, 63K has the same structure as that of the cover 63Y, and is explained like the cover 63Y. For this reason, descriptions of the covers 63M, 63C, 63K will be omitted.

6.2 Operations and Effects of Fourth Embodiment

According to the fourth embodiment, as shown in FIG. 18 and FIG. 20, when the lever 62Y contacts the protrusion 74 of the main housing 2 and then rotatably moves, the exposure head 14Y connected to the lever 62Y moves.

That is, the lever 62Y serving as a part of the drawer unit 60 other than the exposure head 14Y contacts the protrusion 74 of the main housing 2 to move the exposure head 14Y.

For this reason, in comparison with a case in which the exposure head 14Y contacts the main housing 2, an impact occurring when the exposure head 14Y contacts the main housing 2 can be suppressed from being transmitted to the exposure head 14Y.

While the disclosure has been described in detail with reference to the above aspects thereof, it would be apparent to those skilled in the art that various changes and modifications may be made therein without departing from the scope of the claims.

What is claimed is:

1. An image forming apparatus comprising:

a main housing including a first contact member;

a first drum cartridge including a first photosensitive drum; and a drawer unit configured such that the first drum cartridge is mounted thereon, the drawer unit being configured to move in a moving direction between an internal position at which the drawer unit is located inside the main housing and an external position at which the drawer unit is located outside the main housing, the drawer unit including:

a drawer frame;

a first exposure head configured to move between a first adjacent position at which the first exposure head is adjacent to the first photosensitive drum and a first spaced position at which the first exposure head is farther spaced away from the first photosensitive drum than at the first adjacent position; and a second contact member that is a part of the drawer unit other than the first exposure head, the first exposure head being configured to move from the first adjacent position to the first spaced position due to a contact between the first contact member and the second contact member when the drawer unit moves from the internal position to the external position, wherein the drawer unit includes a moving member configured to contact both the second contact member and the first exposure head, and wherein, when the drawer unit moves from the internal position to the external position, the first contact member contacts and moves the second contact member, the second contact member contacts and moves the moving member, and the moving member contacts and moves the first exposure head.

2. The image forming apparatus according to claim 1, wherein the second contact member is a first lever configured to rotatably move relative to the drawer frame, the first lever being configured to move between a pressing position at which the first lever presses the moving member and a pressing release position at which pressing against the moving member is released, the first lever being configured to move from the pressing release position to the pressing position when the drawer unit moves from the internal position to the external position; and wherein the first exposure head moves from the first adjacent position to the first spaced position due to movement of the first lever from the pressing release position to the pressing position.

3. The image forming apparatus according to claim 2, wherein the first lever includes:

a first rod configured to contact the first contact member when the drawer unit moves from the internal position to the external position; and a second rod configured to press the moving member when the first lever is located at the pressing position; and wherein the moving member is a second lever configured to rotatably move by being pressed by the first lever, the second lever including:

a first rod configured to contact the second rod of the first lever; and a second rod configured to contact the first exposure head.

4. The image forming apparatus according to claim 2, wherein the drawer unit includes a holding mechanism configured to hold the first lever at the pressing position.

5. The image forming apparatus according to claim 4, wherein the holding mechanism includes a ratchet.

6. The image forming apparatus according to claim 5, wherein the first lever includes a plurality of gear teeth arranged in a rotational direction of the first lever; and wherein the drawer unit includes:

a stopper constituting the ratchet together with the plurality of gear teeth, the stopper being configured to move between an engagement position at which the stopper engages the gear teeth and an engagement release position at which engagement with the gear teeth is released; and a third lever configured to move between:

a contact position at which the third lever contacts the stopper to cause the stopper to be located at the engagement position; and a spaced position at which the third lever is spaced away from the stopper, the third lever including a first protrusion configured to contact the stopper when the third lever is located at the contact position.

7. The image forming apparatus according to claim 6, wherein the first lever includes:

a first rod configured to contact the first contact member when the drawer unit moves from the internal position to the external position; and a second rod configured to press the moving member when the first lever is located at the pressing position;

wherein the third lever is configured to rotatably move about a rotational axis of the first lever; and wherein the third lever includes:

a first rod configured to contact the first contact member together with the first rod of the first lever when the drawer unit moves from the internal position to the external position; and a second rod configured to contact the first contact member when the drawer unit moves from the external position to the internal position.

8. The image forming apparatus according to claim 6, wherein the third lever includes a second protrusion configured to press the first lever from the pressing position toward the pressing release position when the third lever moves from the contact position to the spaced position.

9. The image forming apparatus according to claim 6, wherein the third lever includes a third protrusion;

wherein the drawer unit includes a spring configured to contact the third protrusion of the third lever, the spring being configured to press the third protrusion in a direction in which the third lever moves from the spaced position to the contact position when the third lever is located at the contact position; and wherein the third lever, the spring, the plurality of gear teeth, and the stopper constitute the holding mechanism.

10. The image forming apparatus according to claim 9, wherein the spring is configured to press the third protrusion in a direction in which the third lever moves from the contact position to the spaced position when the third lever is located at the spaced position.

11. The image forming apparatus according to claim 1, wherein the first contact member includes a first rack gear;

wherein the second contact member is a first gear configured to rotate by engaging the first rack gear when the drawer unit moves between the internal position and the external position;

wherein the moving member is a first wire connecting the first gear with the first exposure head, the first wire being configured to be wound due to rotation of the first gear when the drawer unit moves from the internal position to the external position; and wherein the first exposure head moves from the first adjacent position to the first spaced position due to winding of the first wire.

12. The image forming apparatus according to claim 11, wherein the drawer unit includes a first spring configured to draw the first exposure head located at the first spaced position toward the first adjacent position.

13. The image forming apparatus according to claim 11, wherein the drawer unit includes:

a lock member configured to move between:

a lock position at which the lock member locks the first exposure head at the first spaced position; and a lock release position at which lock against the first exposure head is released; and a second spring configured to press the lock member located at the lock release position toward the lock position; and wherein the main housing includes a protrusion configured to contact the lock member located at the lock position when the drawer unit moves from the external position to the internal position.

14. The image forming apparatus according to claim 13, further comprising a second photosensitive drum, wherein the drawer unit includes a second exposure head configured to move between:

a second adjacent position at which the second exposure head is adjacent to the second photosensitive drum; and a second spaced position at which the second exposure head is farther away from the second photosensitive drum than at the second adjacent position;

wherein the first contact member includes a second rack gear;

wherein the drawer unit includes:

a second gear configured to rotate by engaging the second rack gear when the drawer unit moves between the internal position and the external position;

a second wire connecting the second gear with the second exposure head;

a first pulley in contact with the first wire; and a second pulley in contact with the second wire; and wherein a distance between the first exposure head and the first pulley located at the first adjacent position is same as a distance between the second exposure head and the second pulley located at the second adjacent position.

15. The image forming apparatus according to claim 14, wherein a position of the second rack gear in an upper-lower direction is different from a position of the first rack gear in the upper-lower direction.

16. The image forming apparatus according to claim 1, wherein the first contact member includes a rack gear;

wherein the drawer unit includes a spring configured to press the first exposure head from the first spaced position toward the first adjacent position;

wherein the second contact member is a gear configured to rotate by engaging the rack gear when the drawer unit moves between the internal position and the external position;

wherein the gear includes a cam;

wherein, when the drawer unit moves from the internal position to the external position, the cam is configured to move to a pressing position at which the cam causes the first exposure head to be located at the first spaced position, due to rotation of the gear; and wherein, when the drawer unit moves from the external position to the internal position, the cam is configured to move to a pressing release position at which pressing against the first exposure head is released, due to rotation of the gear.

17. The image forming apparatus according to claim 16, wherein the first exposure head includes a first flat surface configured to contact the cam; and wherein the cam includes a second flat surface configured to contact the first flat surface when the cam is located at the pressing position.

18. The image forming apparatus according to claim 16, wherein the second contact member is a lever connected to the first exposure head, the lever being configured to rotatably move between:

a first position at which the lever causes the first exposure head to be located at the first adjacent position; and a second position at which the lever causes the first exposure head to be located at the first spaced position.

19. The image forming apparatus according to claim 18, wherein the lever includes:

a rotating shaft;

a first rod connected to the first exposure head; and a second rod configured to contact the first contact member; and wherein a position of the second rod in a direction in which the rotating shaft extends is different from a position of the first rod in the direction in which the rotating shaft extends.

20. The image forming apparatus according to claim 19, further comprising:

a first developing cartridge configured to store toner to be supplied to the first photosensitive drum and to be mounted on the drawer unit, the first developing cartridge including a coupling, wherein the lever includes a concave part in which the coupling is fitted when the lever is located at the first position.

21. The image forming apparatus according to claim 19, wherein the drawer unit includes a metal plate to which the first photosensitive drum is fixed; and wherein the lever is configured to contact the metal plate when the lever is located at the first position.

22. The image forming apparatus according to claim 16, wherein the drawer unit includes a cover configured to cover the first exposure head when the first exposure head is located at the first spaced position.

23. An image forming apparatus comprising:

a main housing including a first contact member;

a first drum cartridge including a first photosensitive drum; and a drawer unit configured such that the first drum cartridge is mounted thereon, the drawer unit being configured to move in a moving direction between an internal position at which the drawer unit is located inside the main housing and an external position at which the drawer unit is located outside the main housing, the drawer unit including:

a drawer frame;

a first exposure head configured to move between a first adjacent position at which the first exposure head is adjacent to the first photosensitive drum and a first spaced position at which the first exposure head is spaced farther away from the first photosensitive drum than at the first adjacent position; and a second contact member that is a part of the drawer unit other than the first exposure head, the first exposure head being configured to move from the first adjacent position to the first spaced position due to a contact between the first contact member and the second contact member when the drawer unit moves from the internal position to the external position, wherein the first contact member includes a rack gear, wherein the drawer unit includes a spring configured to press the first exposure head from the first spaced position toward the first adjacent position, wherein the second contact member is a gear configured to rotate by engaging the rack gear when the drawer unit moves between the internal position and the external position;

wherein the gear includes a cam, wherein, when the drawer unit moves from the internal position to the external position, the cam is configured to move to a pressing position at which the cam causes the first exposure head to be located at the first spaced position, due to rotation of the gear, and wherein, when the drawer unit moves from the external position to the internal position, the cam is configured to move to a pressing release position at which pressing against the first exposure head is released, due to rotation of the gear.

24. The image forming apparatus according to claim 23, wherein the first exposure head includes a first flat surface configured to contact the cam; and wherein the cam includes a second flat surface configured to contact the first flat surface when the cam is located at the pressing position.

25. The image forming apparatus according to claim 23, wherein the second contact member is a lever connected to the first exposure head, the lever being configured to rotatably move between:

a first position at which the lever causes the first exposure head to be located at the first adjacent position; and a second position at which the lever causes the first exposure head to be located at the first spaced position.

26. The image forming apparatus according to claim 25, wherein the lever includes:

a rotating shaft;

a first rod connected to the first exposure head; and a second rod configured to contact the first contact member; and wherein a position of the second rod in a direction in which the rotating shaft extends is different from a position of the first rod in the direction in which the rotating shaft extends.

27. The image forming apparatus according to claim 26, further comprising:

a first developing cartridge configured to store toner to be supplied to the first photosensitive drum and to be mounted on the drawer unit, the first developing cartridge including a coupling, wherein the lever includes a concave part in which the coupling is fitted when the lever is located at the first position.

28. The image forming apparatus according to claim 26, wherein the drawer unit includes a metal plate to which the first photosensitive drum is fixed; and wherein the lever is configured to contact the metal plate when the lever is located at the first position.

29. The image forming apparatus according to claim 23, wherein the drawer unit includes a cover configured to cover the first exposure head when the first exposure head is located at the first spaced position.

* * * * *